US010378827B2

(12) United States Patent
Ariyama et al.

(10) Patent No.: US 10,378,827 B2
(45) Date of Patent: Aug. 13, 2019

(54) HEAT EXCHANGER

(71) Applicant: MAHLE FILTER SYSTEMS JAPAN CORPORATION, Tokyo (JP)

(72) Inventors: Masahiro Ariyama, Yokohama (JP); Satoshi Suzuki, Fujimino (JP); Takuma Shibata, Saitama (JP); Kenji Yamashita, Higashimurayama (JP); Katsuhiro Isoda, Sayama (JP); Yuki Koshiba, Fujimi (JP)

(73) Assignee: MAHLE FILTER SYSTEMS JAPAN CORPORATION, Tokyo (JP)

( * ) Notice: Subject to any disclaimer, the term of this patent is extended or adjusted under 35 U.S.C. 154(b) by 0 days.

(21) Appl. No.: 15/719,995

(22) Filed: Sep. 29, 2017

(65) Prior Publication Data

US 2018/0094870 A1 Apr. 5, 2018

(30) Foreign Application Priority Data

Sep. 30, 2016 (JP) ..... 2016-194040

(51) Int. Cl.
*F28D 9/00* (2006.01)
*F28F 3/08* (2006.01)
*F28D 21/00* (2006.01)

(52) U.S. Cl.
CPC ..... *F28D 9/0075* (2013.01); *F28D 9/005* (2013.01); *F28D 9/0043* (2013.01); *F28F 3/086* (2013.01); *F28D 2021/0089* (2013.01)

(58) Field of Classification Search
CPC ..... F28D 9/0075; F28D 9/0043; F28D 9/005; F28D 2021/0089; F28D 1/0308; F28D 9/0006; F28D 9/0025; F28D 9/0031; F28D 9/0037; F28D 9/0062; F28D 9/0081; F28D 9/0056; F28D 9/00; F28D 7/00;
(Continued)

(56) References Cited

U.S. PATENT DOCUMENTS 4,615,384 A 10/1986 Shimada et al.
4,712,612 A 12/1987 Okamoto et al.
(Continued)

FOREIGN PATENT DOCUMENTS

DE 11 2013 004 723 T5 6/2015
EP 1 211 473 A2 6/2002
(Continued)

OTHER PUBLICATIONS

Extended European Search Report, dated Feb. 12, 2018, 6 pages.
(Continued)

*Primary Examiner* — Justin M Jonaitis
(74) *Attorney, Agent, or Firm* — Foley & Lardner LLP

(57) ABSTRACT

A heat exchanger includes: the pair of the oil holes being positioned on an outer edge of one of the core plates, being positioned at symmetrical positions with respect to the center of the one of the core plates to sandwich the center of the one of the core plates, and being positioned to sandwich one of the fin plates along the first reference line, and the pair of the coolant holes being positioned on the outer edge of the one of the core plates, being positioned at symmetrical positions with respect to the center of the one of the core plates to sandwich the center of the one of the core plates, and being positioned to sandwich the one of the fin plates along the first reference line.

5 Claims, 17 Drawing Sheets

(58) Field of Classification Search
CPC ..... F28F 3/086; F28F 3/02; F28F 3/08; F28F 3/083; F28F 3/005
USPC ..... 165/166, 164, 165, 167
See application file for complete search history.

(56) References Cited

U.S. PATENT DOCUMENTS

| | | | | |
|---|---|---|---|---|
| 4,815,532 | A | 3/1989 | Sasaki et al. | |
| 9,921,005 | B2 * | 3/2018 | Bluetling | F28F 3/00 |
| 2002/0066552 | A1 | 6/2002 | Komoda | |
| 2003/0201094 | A1 * | 10/2003 | Evans | F28D 9/005 165/109.1 |
| 2004/0177668 | A1 * | 9/2004 | Sagasser | B21D 13/02 72/326 |
| 2004/0251004 | A1 | 12/2004 | Stoynoff, Jr. | |
| 2005/0194123 | A1 * | 9/2005 | Strahle | F28D 9/0012 165/167 |
| 2006/0169445 | A1 | 8/2006 | Sato et al. | |
| 2007/0000639 | A1 * | 1/2007 | Ozawa | F28D 9/0043 165/41 |
| 2007/0125527 | A1 * | 6/2007 | Flik | F02B 29/0412 165/140 |
| 2009/0032231 | A1 * | 2/2009 | Komoda | F28D 9/005 165/166 |
| 2012/0031593 | A1 | 2/2012 | Uno et al. | |
| 2012/0205085 | A1 | 8/2012 | Ariyama | |
| 2015/0226496 | A1 * | 8/2015 | Cui | F28F 3/027 165/166 |

FOREIGN PATENT DOCUMENTS

| | | | |
|---|---|---|---|
| JP | H08-313183 | A | 11/1996 |
| JP | 2011-7411 | A | 1/2011 |
| JP | 2012-017943 | A | 1/2012 |

OTHER PUBLICATIONS

Extended European Search Report, dated Feb. 6, 2018, 7 pages.
USPTO Office Action, U.S. Appl. No. 15/719,970, dated Jul. 26, 2018, 11 pages.
USPTO Notice of Allowance, U.S. Appl. No. 15/719,970, dated Dec. 21, 2018, 6 pages.

* cited by examiner

HEAT EXCHANGER

BACKGROUND OF THE INVENTION

The present invention relates to a heat exchanger.

Japanese Patent Application Publication No. 2011-7411 discloses a heat exchanger including a plurality of stacked core plates, oil flow passages each formed between adjacent two of the core plates, and coolant flow passages each formed between adjacent two of the core plates. The oil flow passages and the coolant flow passages are alternatingly formed.

In the heat exchanger of the above-described patent document, a fin plate is disposed in an oil flow passage. Each of the core plates constituting a coolant flow passage includes a plurality of protruding portions protruding toward the coolant flow passage. The fin plates and the protruding portions are provided for improving the heat exchanging efficiency between the oil and the coolant.

SUMMARY OF THE INVENTION

However, in the heat exchanger of the above-described patent document, the oil flows from one of a pair of oil holes provided on a diagonal line of the core plate, to the other of the pair of the oil holes. Moreover, the oil flows from one of a pair of coolant holes provided on a diagonal line of the core plate, to the other of the pair of the coolant holes.

Accordingly, the oil is easy to flow along the diagonal line of the core plate in which the oil holes are formed, the diagonal line becoming a shortest distance.

That is, the flow of the fluid flowing between the core plates becomes nonuniform flow as a whole. There are room for improvement of the heat exchange efficiency.

According to one aspect of the present invention, A heat exchanger comprises: a plurality of rectangular core plates stacked; a plurality of plate oil flow passages and a plurality of plate coolant flow passages alternatingly formed between the plurality of the core plates; a plurality of rectangular fin plates each disposed at least to one flow passage of the plurality of the plate oil flow passages and the plate coolant flow passages; the core plates each including a pair of oil holes and a pair of coolant holes; in a case where a first reference line and a second reference line are defined as lines which pass through a center of the fin plate, and which are perpendicular to each other in a plane of each of the core plates, each of the fin plates having an anisotropy in which a passage resistance in a direction parallel to the first reference line is smaller than a passage resistance parallel to the second reference line, the pair of the oil holes being positioned on an outer edge of one of the core plates, the pair of the oil holes being positioned at symmetrical positions with respect to the center of the one of the core plates to sandwich the center of the one of the core plates, and the pair of the oil holes being positioned to sandwich one of the fin plates along the first reference line, and the pair of the coolant holes being positioned on the outer edge of the one of the core plates, the pair of the coolant holes being positioned at symmetrical positions with respect to the center of the one of the core plates to sandwich the center of the one of the core plates, and the pair of the coolant holes being positioned to sandwich the one of the fin plates along the first reference line, wherein the pair of the oil holes are positioned on a diagonal line of one of the core plates; and the pair of the coolant holes are positioned on a diagonal line of the one of the core plates which is not different from the diagonal line on which the pair of the oil holes are formed.

DETAILED DESCRIPTION OF THE INVENTION

Hereinafter, embodiments of the present invention are explained in detail with reference to the drawings. Besides, in below-described explanations, terms such as "upward", "downward", "a top portion", and "a bottom portion" are used with reference to a posture of FIG. 1. However, the present invention is not limited to these.

Figure 1:
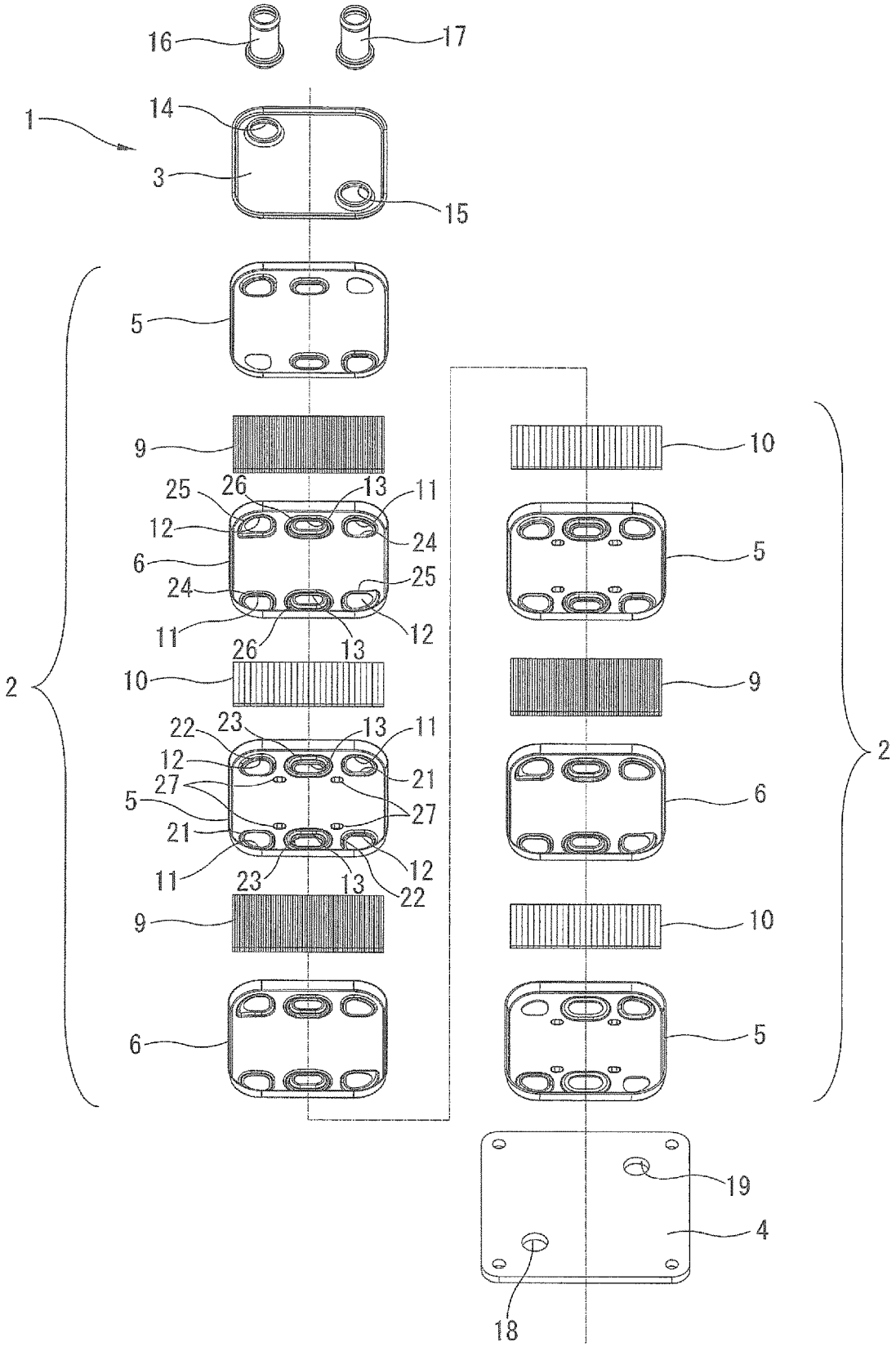
FIG. 1 is an exploded perspective view showing an oil cooler according to the present invention.
Figure 2:
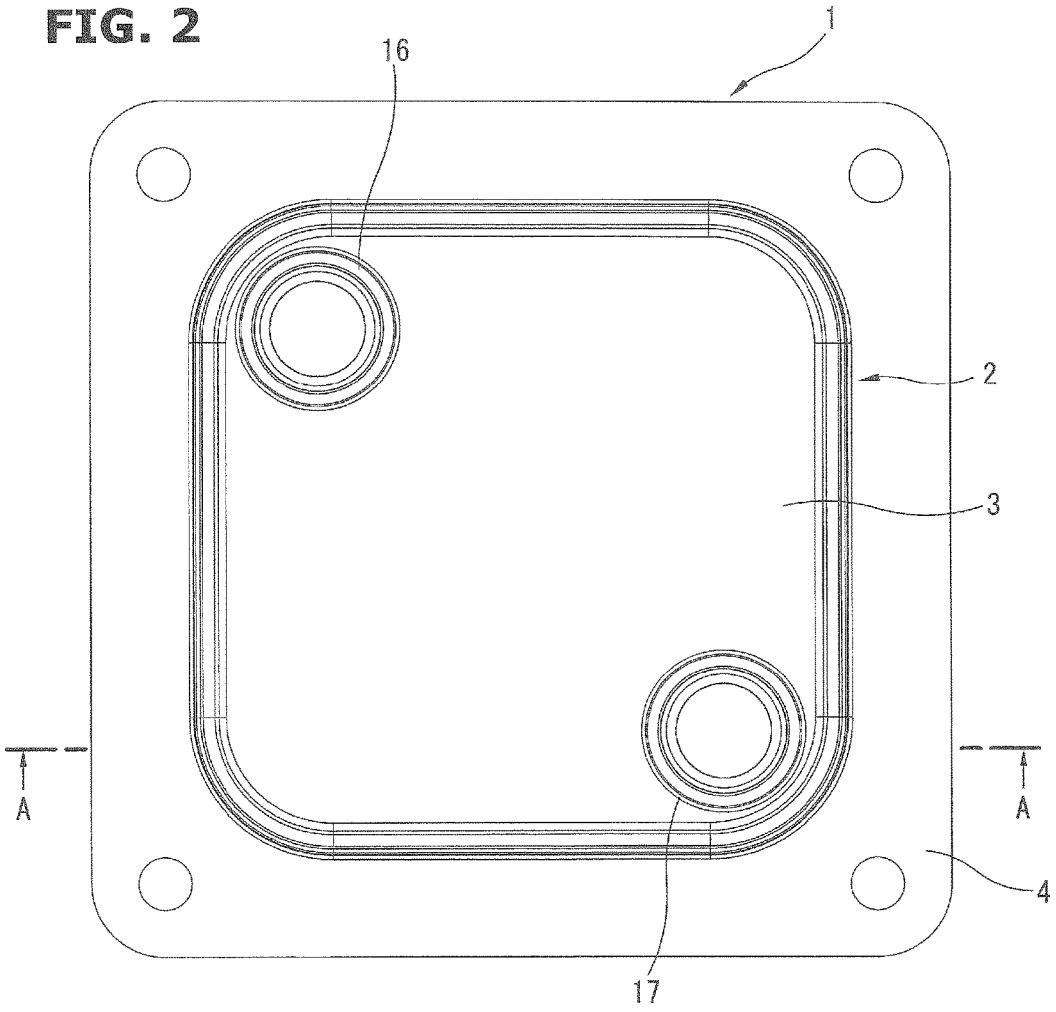
FIG. 2 is a plan view showing the oil cooler according to the present invention.
Figure 3:
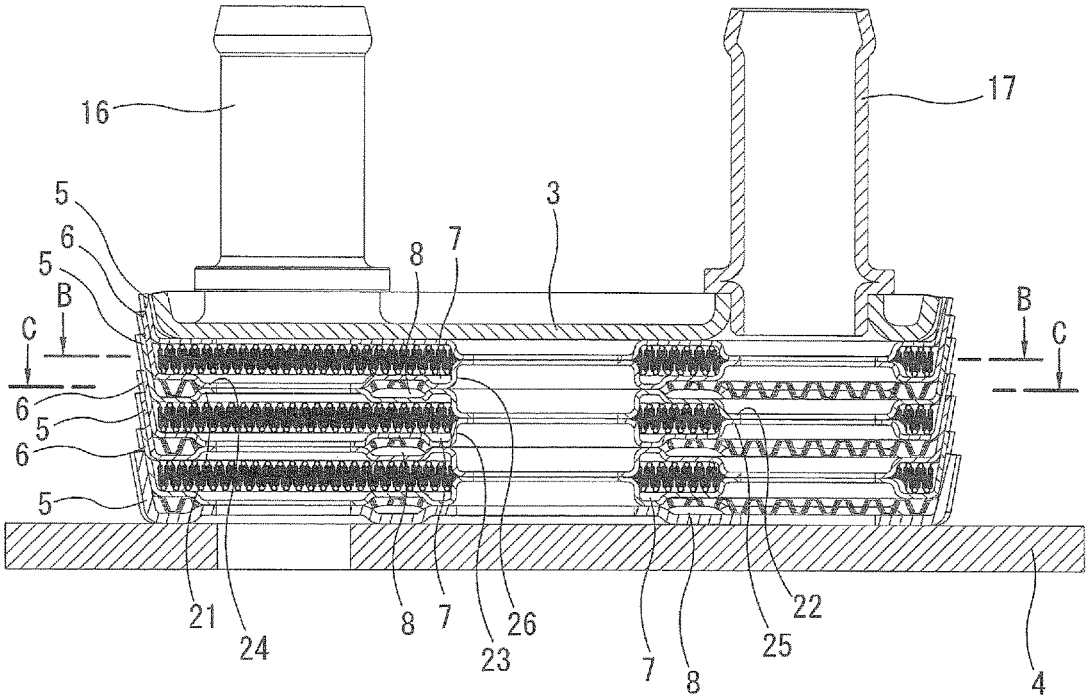
FIG. 3 is a sectional view taken along a section line A-A of FIG. 2.

First, a summary of an oil cooler 1 which is a heat exchanger according a first embodiment of the present invention is explained with reference to FIG. 1 to FIG. 3. FIG. 1 is an exploded perspective view showing the oil cooler 1. FIG. 2 is a plan view showing the oil cooler. FIG. 3 is a sectional view taken along a section line A-A of FIG. 2.

As shown in FIG. 1, the oil cooler 1 includes a heat exchanger section 2 arranged to perform a heat exchange between an oil and a coolant; a top plate 3 which has a relatively large thickness, and which is mounted on an upper surface of the heat exchanger section 2; and a bottom plate 4 which has a relatively large thickness, and which is mounted on a lower surface of the heat exchanger section 2.

The heat exchanger section 2 includes first core plates 5 which are a plurality (many) of core plates; and second core plates 6 which are a plurality (many) of core plates. The first core plates 5 and the second core plates 6 have an identical basic structure. The first core plates 5 and the second core plates 6 are alternatively stacked each other, so that plate oil flow passages 7 (cf. FIG. 3) and plate coolant flow passages 8 (cf. FIG. 3) are formed between the first core plates 5 and the second core plates 6. In the oil cooler 1 according to this embodiment, three plate oil flow passages 7 and three plate coolant flow passages 8 are formed within the heat exchanger section 2. The plate oil flow passages 7 and the plate coolant fluid passages 8 correspond to fluid passages.

In this embodiment, as shown in FIG. 3, each of the plate oil flow passages 7 is formed between a lower surface of one of the first core plates 5 and an upper surface of one of the second core plates 6. Each of the plate coolant flow passages 8 is formed between an upper surface of one of the first core plates 5 and a lower surface of one of the second core plates 6. First fin plates 9 which are fin plates are disposed, respectively, within the plate oil flow passages 7. Second fin plates 10 which are fin plates are disposed, respectively, within the plate coolant flow passages 8.

The plurality of first and second core plates 5 and 6, the top plate 3, the bottom plate 4, the plurality of the first fin plates 9, and the plurality of the second fin plates 10 are integrally jointed with each other by brazing. Specifically, these plates 3, 5, and 6 are formed by using clad metals formed by covering surfaces of base material of the aluminum alloy with soldering layer. The above-described plates are temporarily assembled at predetermined positions. Then, this is heated within a furnace, so that the plates are jointed by the brazing.

The first core plates 5 which are positioned at an uppermost portion and a lowermost portion of the heat exchanger section 2 have structures slightly different from structures of the normal first core plate 5 which are positioned at intermediate portions of the heat exchanger section 2, for relationship with the top plate 3 and the bottom plate 4.

For example, in this embodiment, the first core plate positioned at the lowermost portion of the heat exchanger 2 is thicker than the other first core plates 5.

Each of the first core plates 5 and the second core pleats 6 is formed by press-forming a thin base metal of the aluminum alloy. Each of the first core plates 5 and the second core pleats 6 is formed into a rectangular overall shape (substantially square). Each of the first core plates 5 and the second core plates 6 includes a pair of oil through holes 11 and 11 which are a pair of oil holes, and a pair of coolant through holes 12 and 12 which are a pair of coolant holes.

Moreover, in this embodiment, each of the first core plates 5 and the second core plates 6 includes a pair of through holes 13 and 13 through which the oil and the coolant do not pass, as shown in FIG. 1. With this, the first core plate 5 and the second core plate 6 have general versatility. In this embodiment, as shown in FIG. 3, the through holes 13 are connected with each other in the upward and downward directions. However, the through holes 13 are not connected with the plate oil flow passages 7 and the plate coolant flow passages 8.

The top plate 3 includes a coolant introduction portion 14 connected to one of the coolant through holes 12 of the uppermost portion of the heat exchanger section 2; and a coolant discharge portion 15 connected to the other of the coolant through holes 12 of the uppermost portion of the heat exchanger section 2. As shown in FIG. 1 and FIG. 3, the coolant introduction portion 14 is connected to a coolant introduction pipe 16. As shown in FIG. 1 and FIG. 3, the coolant discharge portion 15 is connected to a coolant discharge pipe 17. The oil cooler 1 is arranged to receive the coolant from the coolant introduction pipe 16, and to discharge the coolant from the coolant discharge pipe 17.

As shown in FIG. 1, the bottom plate 4 includes an oil introduction through hole 18 connected to one of the oil through holes 11 of the lowermost portion of the heat exchanger section 2; and an oil discharge portion 19 connected to the other of the oil through holes 11 of the lowermost portion of the heat exchanger portion 2. The oil introduction portion 18 and the oil discharge portion 19 of the bottom plate 4 are mounted to a cylinder block (not shown) and so on through a gasket (not shown) arranged to seal the introduction portion 18, the discharge portion 19, and so on. The oil cooler 1 is arranged to receive the oil from the oil introduction portion 18, and to discharge the oil from the oil discharge portion 19.

The pair of the oil through holes 11 and 11 are positioned at an outer edge of each of the core plates. The pair of the oil through holes 11 and 11 are formed at positions symmetrical with each other with respect to a center of each of the core plates (to sandwich the center of each of the core plates). Specifically, as shown in FIG. 1, the pair of the oil through holes 11 are positioned at the outer edge of each of the core plates. Moreover, the pair of the oil through holes 11 are formed at positions symmetrical with each other with respect to the center of each of the core plates (to sandwich the center of each of the core plates) on a diagonal line of each of the core plates.

The pair of the coolant through holes 12 and 12 are positioned at an outer edge of each of the core plates. The pair of the coolant through holes 12 and 12 are formed at positions symmetrical with each other with respect to a center of each of the core plates (to sandwich the center of each of the core plates). Specifically, as shown in FIG. 1, the pair of the coolant through holes 12 are positioned at the outer edge of each of the core plates. Moreover, the pair of the coolant through holes 12 are formed at positions symmetrical with each other with respect to the center of each of the core plates (to sandwich the center of each of the core plates) on a diagonal line of the core plate.

Besides, the coolant through holes 12 are formed so as not to be overlapped with the oil through holes 11. Specifically, the coolant through holes 12 are formed on the diagonal line of the core plate which is different from the diagonal line of the core plate of the oil through holes 11.

As shown in FIG. 1, the pair of the through holes 13 and 13 are positioned on the outer edge of the core plate at positions symmetrical with each other with respect to the center of each of the core plates (to sandwich the center of each of the core plates). Furthermore, each of the through holes 13 and 13 is positioned between one of the oil through holes 11 and one of the coolant through holes 12.

The coolant introduced from the coolant introduction portion 14 of the top plate 3 flows through the plate coolant flow passages 8. As a whole, the coolant flows within the heat exchanger section 2 in a direction perpendicular to a stacking direction of the core plates. Then, the coolant reaches the coolant discharge portion 15 of the top plate 3. Besides, the oil introduced from the oil introduction portion 18 of the bottom plate 4 flows through the plate oil flow passages 7. As a whole, the oil flows within the heat exchanger section 2 in a direction perpendicular to the stacking direction of the core plates. Then, the oil reaches the oil discharge portion 19 of the bottom plate 4.

As shown in FIG. 1 and FIG. 3, each of the first core plates 5 includes boss portions 21 each of which is formed around one of the oil through holes 11, and each of which is a raised shape raised to protrude toward the plate coolant flow passage side; and boss portions 22 each of which is formed around one of the coolant through holes 12, and each of which is a raised shape raised to protrude toward the plate oil flow passage side. Moreover, as shown in FIG. 1 and FIG. 3, each of the first core plate 5 includes boss portions 23 each of which is formed around one of the through holes 13, and each of which has double annular raised shapes raised, respectively, to protrude toward the plate coolant flow passage side (on an outer circumference side) and the plate oil flow passage side (on an inner circumference side). Besides, the first core plate 5 positioned at the lowermost position includes the boss portions 23 each of which is formed around one of the through holes 13, and which is raised to protrude only toward the plate coolant flow passage side.

As shown in FIG. 1 and FIG. 3, each of the second core plates 6 includes boss portions 24 each of which is formed around one of the oil through holes 11, and each of which is raised to protrude toward the plate coolant flow passage side; and boss portions 25 each of which is formed around one of the coolant through holes 12, and each of which is raised to protrude toward the plate oil flow passage side. Moreover, as shown in FIG. 1 and FIG. 3, each of the second core plates 6 includes boss portions 26 each of which is formed around one of the through holes 13, and which has double annular raised shapes raised, respectively, to protrude toward the plate coolant flow passage side (on an outer circumference side) and the plate oil flow passage side (on an inner circumference side).

Accordingly, constant clearances (gaps) which are the plate oil flow passages 7 and the plate coolant flow passages 8 are formed between the first core plates 5 and the second core plates 6, by alternatingly combining the first core plates 5 and the second core plates 6.

Each of the boss portions 21 around one of the oil through holes 11 of one of the first core plates 5 is joined to one of the boss portions 24 around the one of the oil through holes 11 of one of the second core plates 6 which is adjacent to the one of the first core plates 5. With this, the two plate oil flow passages 7 which are adjacent to each other in the upward and downward directions are connected to each other. Moreover, the adjacent two plate oil flow passages 7 are separated from the plate coolant flow passage 8 between the adjacent two plate oil flow passages 7. Accordingly, in a state where the plurality of the first core plates 5 and the second core plates 6 are joined with each other, the plate oil flow passages 7 are connected with each other through the plurality of the oil through holes 11.

Each of the boss portions 25 around one of the coolant through holes 12 of one of the second core plates 6 is joined to one of the boss portions 22 around one of the coolant through holes 12 of one of the first core plates 5 which is adjacent to the one of the second core plates 6. With this, the two plate coolant flow passages 8 which are adjacent to each other in the upward and downward directions are connected to each other. Moreover, the adjacent two plate coolant flow passages 8 are separated from the plate oil flow passage 7 between the adjacent two plate coolant passages 8. Accordingly, in a state where the plurality of the first core plates 5 and the second core plates 6 are joined with each other, the plate coolant flow passages 8 are connected with each other through the plurality of the coolant through holes 12.

Each of the boss portions 23 around one of the through holes 13 of one of the first core plates 5 is joined to one of the boss portions 26 around one of the through holes 13 of the upper and lower second core plates 6 which are adjacent to the one of the first core plates 5. Accordingly, in this embodiment, in a state where the plurality of the first core plates 5 and the plurality of the second core plates 6 are joined to each other, the through holes 13 are not connected to the plate oil flow passages 7 and the plate coolant flow passages 8.

Besides, a symbol 27 in FIG. 1 represents a positioning protrusion portion (described later) formed in each of the first core plates 5.

Each of the first fin plates 9 has a substantially rectangular outer profile including a pair of longitudinal sides 9*a* confronting each other; and a pair of lateral sides 9*b* confronting each other.

Figure 4:
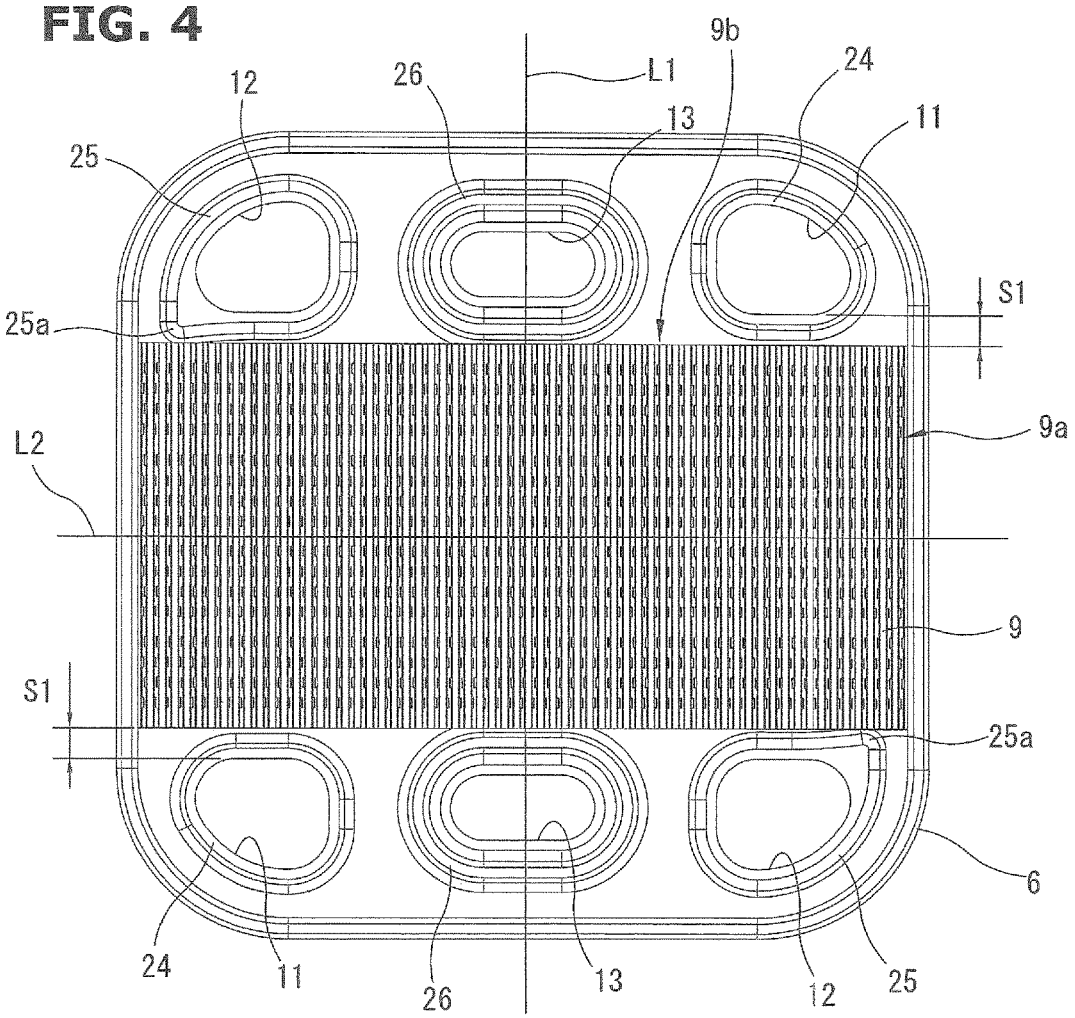
FIG. 4 is an explanation view showing a relationship between a first fin plate and a second fin plate used in the oil cooler according to the present invention.

As shown in FIG. 4, each of the first fin plates 9 is positioned by the boss portions 25 of one of the second core plates 6. Specifically, in this embodiment, each of the first fin plates 9 is positioned between a pair of the boss portions 25 and 25 which confronts each other, by positioning protrusions 25*a* each protruding from one of the boss portions 25 and 25 toward the other of the boss portions 25 and 25.

In a case where a first reference line L1 and a second reference line L2 are defined as lines which pass through a center of the fin plate in a plane of one of the first fin plates 9, and which are perpendicular to each other in the plane of the one of the first fin plates 9, each of the first fin plates 9 has an anisotropy (anisotropism) in which a flow resistance in a direction parallel to the first reference line L1 is smaller than a flow resistance in a direction parallel to the second reference line L2. That is, each of the first fin plates 9 has an anisotropy in which a flow resistance in a direction parallel to the lateral side 9*b* is greater than a flow resistance in a direction parallel to the longitudinal side 9*a*.

Each of the first fin plates 9 is formed so that the both ends (upper and lower ends in FIG. 4) of the each of the first fin plates 9 are positioned on the center side of one of the second core plates 6 relative to the oil through holes 11 and the coolant through holes 12 in a direction along the first reference line L1. Moreover, each of the first fin plates 9 is formed so that the both ends (left and right ends in FIG. 4) of the each of the first fin plates 9 are positioned at outer positions of the oil through holes 11 and the coolant through holes 12 in the direction along the second reference line L2. That is, each of the first fin plates 9 has a length of the lateral side 9*b* (which is parallel to the second reference line L2) which is substantially identical to a width of the plate oil flow passage 7. Furthermore, in the plate oil flow passage 7, each of the oil through holes 11 and the coolant through holes 12 is positioned between one of the lateral sides 9*b* of the first fin plate 9, and an outer circumference edge of the second core plate 6 which corresponds to the one of the lateral sides 9*b*, without being covered with the first fin plate 9.

That is, each of the second core plates 6 includes rectangular regions each of which is adjacent to one of the lateral sides 9*b* of the first fin plate 9, and each of which is not covered with the first fin plate 9. Each of the oil through holes 11 and each of the coolant through holes 12 are positioned at one of these rectangular regions. That is, the two oil through holes 11 are positioned to sandwich the first fin plate 9 in a direction along the first reference line L1 The two coolant through holes 12 are positioned to sandwich the first fin plate 9 in a direction along the first reference line L1. Accordingly, in this embodiment, in the plate oil flow passage 7, it is possible to produce a substantially uniform flow of the oil which flows in a in a direction parallel to the first reference line L1 of the first fin plate 9, and which is uniform in the second reference line L2, by the first fin plate 9.

The first fin plate 9 is explained in detail with reference to FIG. 5 to FIG. 8. Besides, for the explanation, two directions which are perpendicular to each other in the plane of the first fin plate 9 are defined as an X direction and a Y direction, as shown in FIG. 5, FIG. 6, and FIG. 8.

Figure 5:
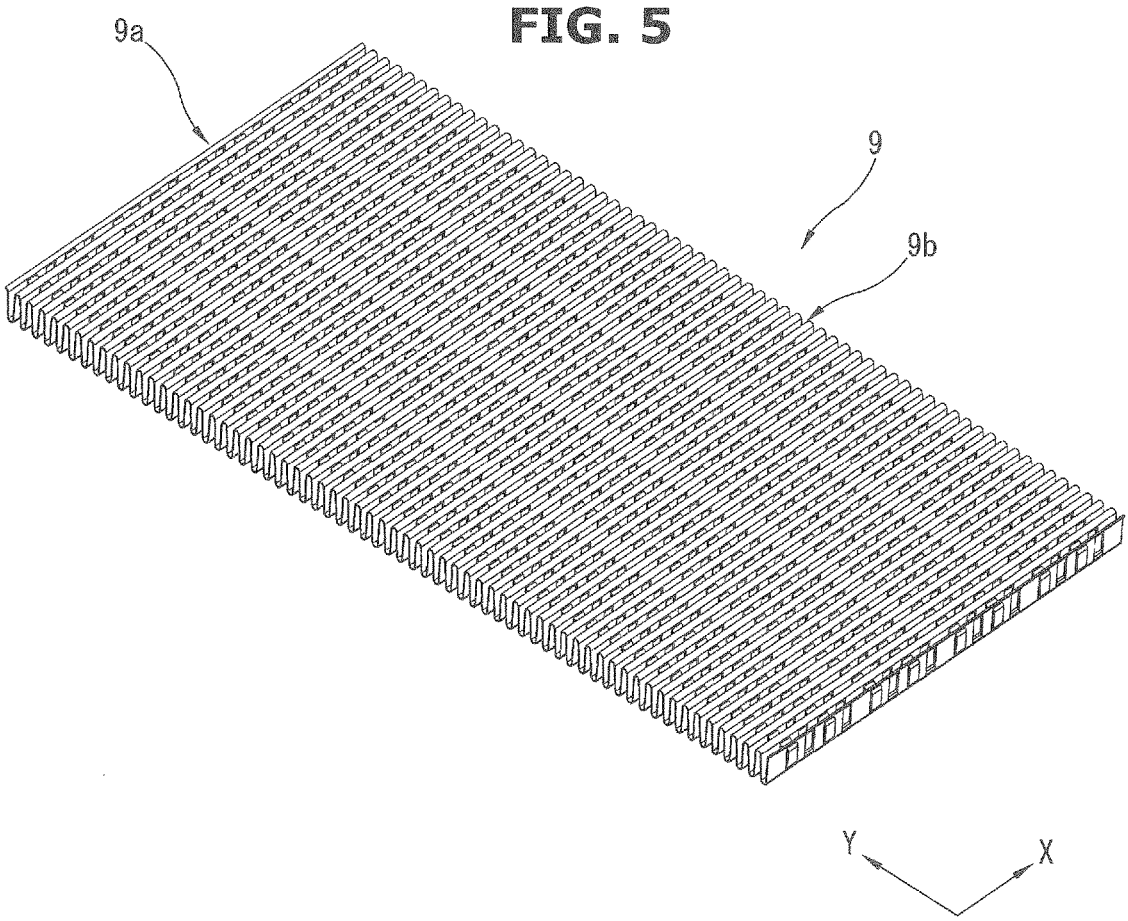
FIG. 5 is a perspective view showing the first fin plate used in the oil cooler according to the present invention.
Figure 6:
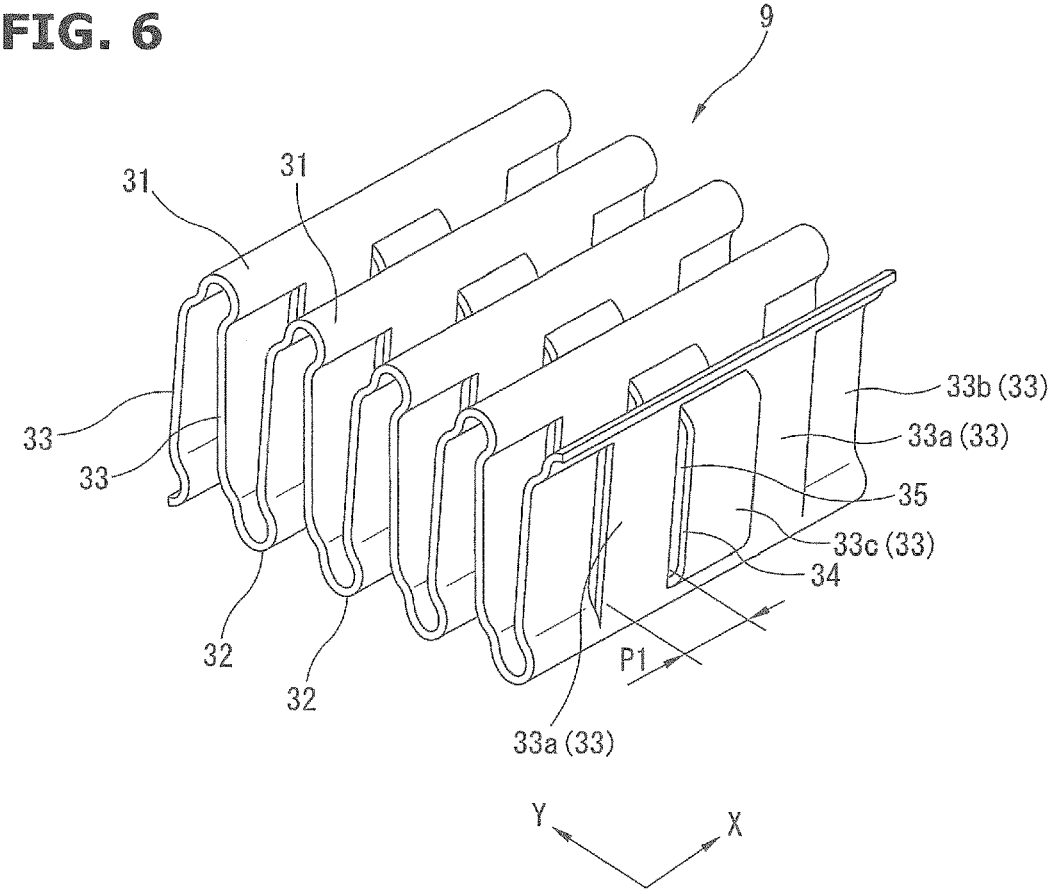
FIG. 6 is an enlarged explanation view showing a main part of the first fin plate used in the oil cooler according to the present invention.
Figure 7:
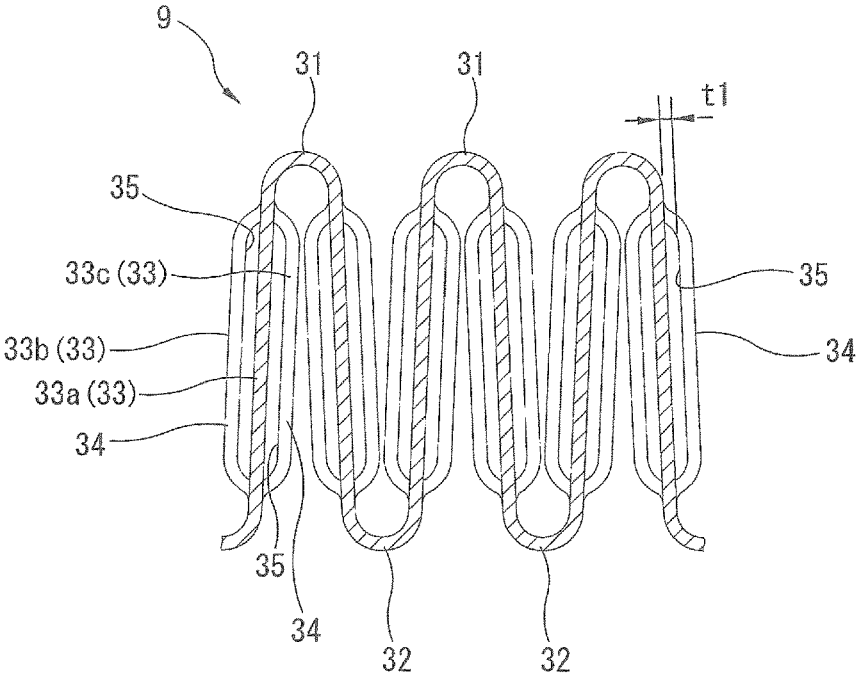
FIG. 7 is a sectional view showing the main part of the first fin plate used in the oil cooler according to the present invention.
Figure 8:
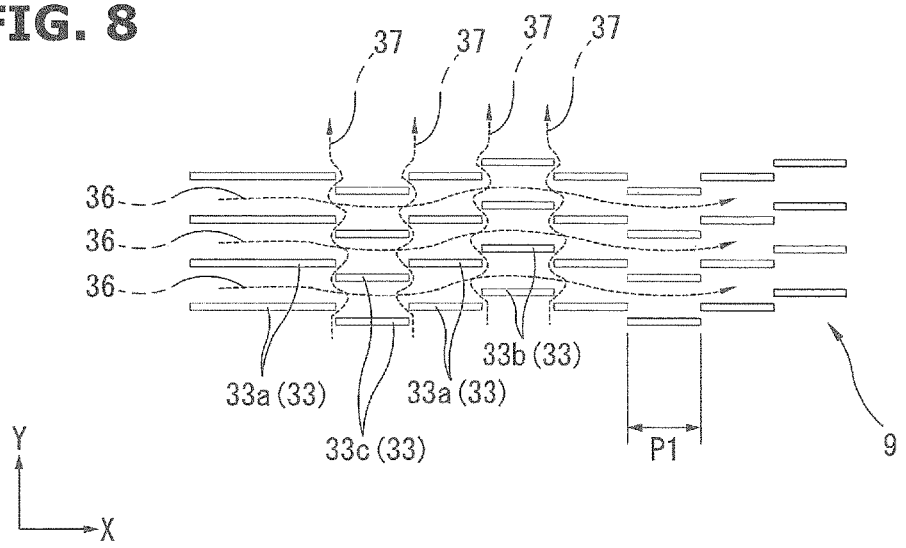
FIG. 8 is an enlarged sectional view which shows the first fin plate, and which is taken along a section line B-B of FIG. 3.

As shown in FIG. 5 to FIG. 7, the first fin plate 9 has a V-shaped corrugated (waveform) shape in which the first fin plate 9 is repeatedly bended at a regular interval. That is, the first fin plate 9 is a corrugated fin formed by bending a base metal while sending the base metal in the Y direction.

As shown in FIG. 6 and FIG. 7, the first fin plate 9 includes top walls 31 which are positioned at top portions of the corrugated shape, and each of which is continuous in the X direction; bottom walls 32 which are positioned at bottom portions of the corrugated shape, and each of which is continuous in the X direction; and foot portions 33 each of which connects one of the top walls 31 and one of the bottom walls 32. Besides, the top walls 31 are substantially identical to the bottom walls 32.

Each of the foot portions 33 of the first fin plate 9 includes reference walls 33*a*, first protruding walls 33*b* each protruding toward one of the foot portions 33 which are adjacent to the reference wall 33*a* in the Y direction; and second protruding walls 33*c* each protruding toward the other of the foot portions 33 which are adjacent to the reference wall 33*a* in the Y direction. One of the first protruding walls 33*b* and one of the second protruding walls 33*c* are positioned on both sides of one of the reference walls 33*b* in the X direction. Two of the reference walls 33*a* are positioned on both sides of one of the first protruding walls 33*b*. Moreover, two of the reference walls 33*a* are positioned on both sides of the second protruding walls 33*c*. In this embodiment, each of the foot portions 33*b* is formed so as to repeat an order of the reference wall 33*a*, the second protruding wall 33*c*, the reference wall 33*a*, and the first protruding wall 33*b* in the X direction.

Moreover, each of the foot portions 33 of one of the first fin plates 9 includes stepped walls 34 formed at a predetermined interval along one of the top walls 31 and one of the bottom walls 32. Each of the stepped walls 34 is a stepped surface between one of the reference walls 33*a* and one of the first protruding walls 33*b*, or a stepped surface between one of the reference walls 33*a* and one of the second protruding walls 33*c*. Accordingly, each of the foot portions 33 is formed into a rectangular corrugated shape along one of the top walls 31 and one of the bottom walls 32 by the reference walls 33*a*, the first protruding walls 33*b*, the second protruding walls 33*c*, and the stepped walls 34 which are repeatedly formed in the X direction. Each of the stepped walls 34 is formed at a position apart from one of the top walls 31 and one of the bottom walls 32.

Furthermore, each of the foot portions 33 of the first fin plate 9 has the corrugated shape which has the same phase as the phase of one of the foot portions 33 that is adjacent to the each of the foot portions 33 in the Y direction. That is, in two of the foot portions 33 which are adjacent to each other in the Y direction, the reference walls 33*a* confront the reference walls 33*a*, the first protruding walls 33*b* confront the first protruding walls 33*b*, and the second protruding walls 33*c* confront the second protruding walls 33*c*.

Each of the stepped walls 34 of one of the foot portions 33 of the first fin plate 9 includes an elongated opening portion 35 having a width equal to or smaller than a thickness of the first fin plate 9. That is, each of the stepped walls 34 of the foot portion 33 of the first fin plate 9 is a stepped surface in which the elongated opening portion 35 having the width equal to or smaller than a thickness of the first fin plate 9 can be formed.

Each of the opening portions 35 of the first fin plate 9 is an elongated through hole along the X direction. Each of the opening portions 35 of the first fin plate 9 may be, for example, an elongated opening having a width t1 of about 0.1 mm in a case where the first fin plates 9 are used in the oil circuit like this embodiment.

In a case where each of the above-described first fin plates 9 is formed, slits extending in the Y direction are intermittently formed in the base metal at a predetermined interval P1 in the X direction. Then, by bending the base metal along these slits, each of the foot portions 33 of the first fin plate 9 becomes the corrugated shape in the X direction. That is, by bending the base metal along these slits, the stepped walls 34, and the elongated opening portions 35 each having the width equal to or smaller than the thickness of the first fin plate 9 are formed in the first fin plate 9.

Then, the base metal in which the opening portions 35 each having the extremely small passage sectional area are formed is bent at predetermined positions in the opposite directions while being sent in the Y direction. With this, the first fin plate 9 is formed into the V-shaped corrugated shape.

FIG. 8 is an enlarged sectional view which shows one of the foot portions 33 of the first fin plate 9, and which is taken along a section passing through the plate oil flow passage 7 in parallel to the surfaces of the first core plate 5 and the second core plate 6.

The reference walls 33*a*, the first protruding walls 33*b*, and the second protruding walls 33*c* of each of the first fin plates 9 are arranged (formed) in a line in a broken line shape by the opening portions 35 formed in the foot portion 33. Moreover, the rows of the adjacent walls are in a complement relationship. The entire are arranged in a staggered arrangement (in a zigzag shape).

Accordingly, when the oil flows in the X direction, the oil linearly flows between the rows of the adjacent foot portions 33 as shown by arrows 36, and the oil flows through the opening portions 35. Consequently, a boundary layer is difficult to be generated. Moreover, the passage resistance is small. When the oil flows in the Y direction, the oil cannot linearly flow since the adjacent rows of the foot portions 33 are superimposed. The oil flows meandering as shown by arrows 37. Moreover, the opening portions 35 through which the oil passes when the oil flows in the Y direction has the extremely small passage sectional area. Accordingly, the passage resistance becomes large when the oil flows in the Y direction. That is, each of the first fin plates 9 has an anisotropy (anisotropism) in which the passage resistance in the X direction is different from the passage resistance in the Y direction. The passage resistance to the flow in the X direction (the direction along the above-described first reference line L1) is relatively small. The passage resistance to the flow in the Y direction (the direction along the above-described second reference line L2) is extremely large.

Each of the second fin plates 10 has a substantially rectangular outer profile including a pair of longitudinal sides 10*a* confronting each other; and a pair of lateral sides 10*b* confronting each other.

Figure 9:
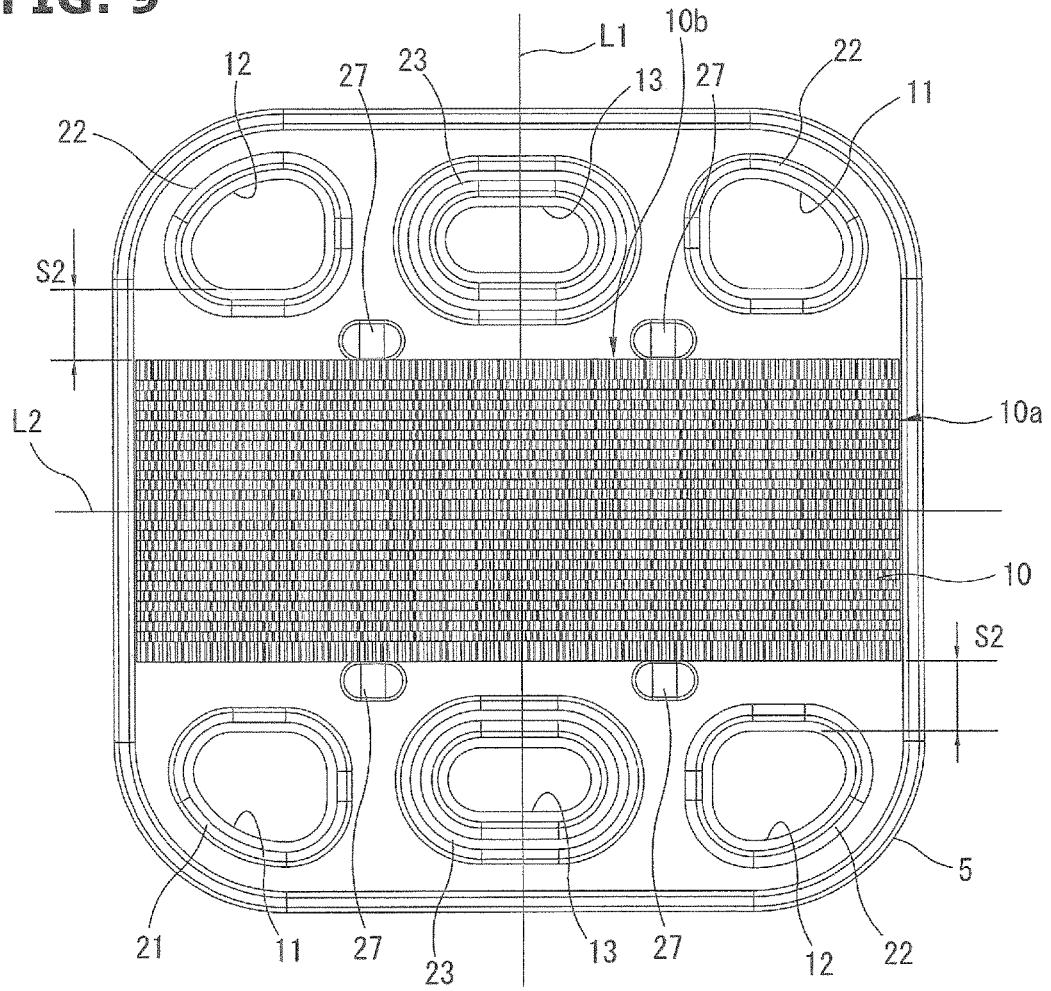
FIG. 9 is an explanation view showing a relationship between a second fin plate and the first core plate which are used in the oil cooler according to the present invention.

As shown in FIG. 9, each of the second fin plates 10 is positioned by a plurality of positioning protrusions 27 formed on the first core plate 5. Specifically, in this embodiment, two of the positioning protrusions 27 are formed on both sides of one of the through holes 13. Each of the positioning protrusions 27 is located on the center side of the corresponding through holes 13. That is, the positioning protrusions 27 are sandwiched by the through holes 22 in upward and downward directions in FIG. 9.

In a case where a first reference line L1 and a second reference line L2 are defined as lines which pass through a center of the fin plate in a plane of one of the second fin plates 10, and which are perpendicular to each other in the plane of the one of the second fin plates 10, each of the second fin plates 10 has an anisotropy (anisotropism) in which a flow resistance in a direction parallel to the first reference line L1 is smaller than a flow resistance in a direction parallel to the second reference line L2. That is, each of the second fin plates 10 has an anisotropy in which a flow resistance in a direction parallel to the lateral side 10*b* is greater than a flow resistance in a direction parallel to the longitudinal side 10*a*.

Each of the second fin plates 10 is formed so that the both ends (upper and lower ends in FIG. 9) of the each of the fin plates 9 are positioned on the center side of one of the second core plates 6 relative to the oil through holes 11 and the coolant through holes 12 in a direction along the first reference line L1. Moreover, each of the second fin plates 10 is formed so that the both ends (left and right ends in FIG. 9) of the each of the second fin plates 10 are positioned at outer positions of the oil through holes 11 and the coolant through holes 12 in the direction along the second reference line L2. That is, each of the second fin plates 10 has a length of the lateral side 10*b* (which is parallel to the second reference line L2) which is substantially identical to a width of the plate is coolant flow passage 8. Furthermore, in the plate coolant flow passage 8, each of the oil through holes 11 and the coolant through holes 12 is positioned between one of the lateral sides 10*b* of the second fin plate 10, and an outer circumference edge of the first core plate 5 which corresponds to the one of the lateral sides 10*b*, without being covered with the second fin plate 10.

That is, each of the first core plates 5 includes rectangular regions each of which is adjacent to one of the lateral sides 10*b* of the second fin plate 10, and each of which is not covered with the second fin plate 10. Each of the oil through holes 11 and each of the coolant through holes 12 are positioned at one of these rectangular regions. That is, the two oil through holes 11 are positioned to sandwich the second fin plate 10 in a direction along the first reference line L1. The two coolant through holes 12 are positioned to sandwich the second fin plate 10 in a direction along the first reference line L1. Accordingly, in this embodiment, in the plate coolant flow passage 8, it is possible to produce a substantially uniform flow of the coolant which flows in a in a direction parallel to the first reference line L1 of the second fin plate 10, and which is uniform in the second reference line L2, by the second fin plate 10.

The second fin plate 10 is explained in detail with reference to FIG. 10 to FIG. 13. Besides, for the explanation, two directions which are perpendicular to each other in the plane of the second fin plate 10 are defined as an X direction and a Y direction, as shown in FIG. 10, FIG. 11, and FIG. 13.

Figure 10:
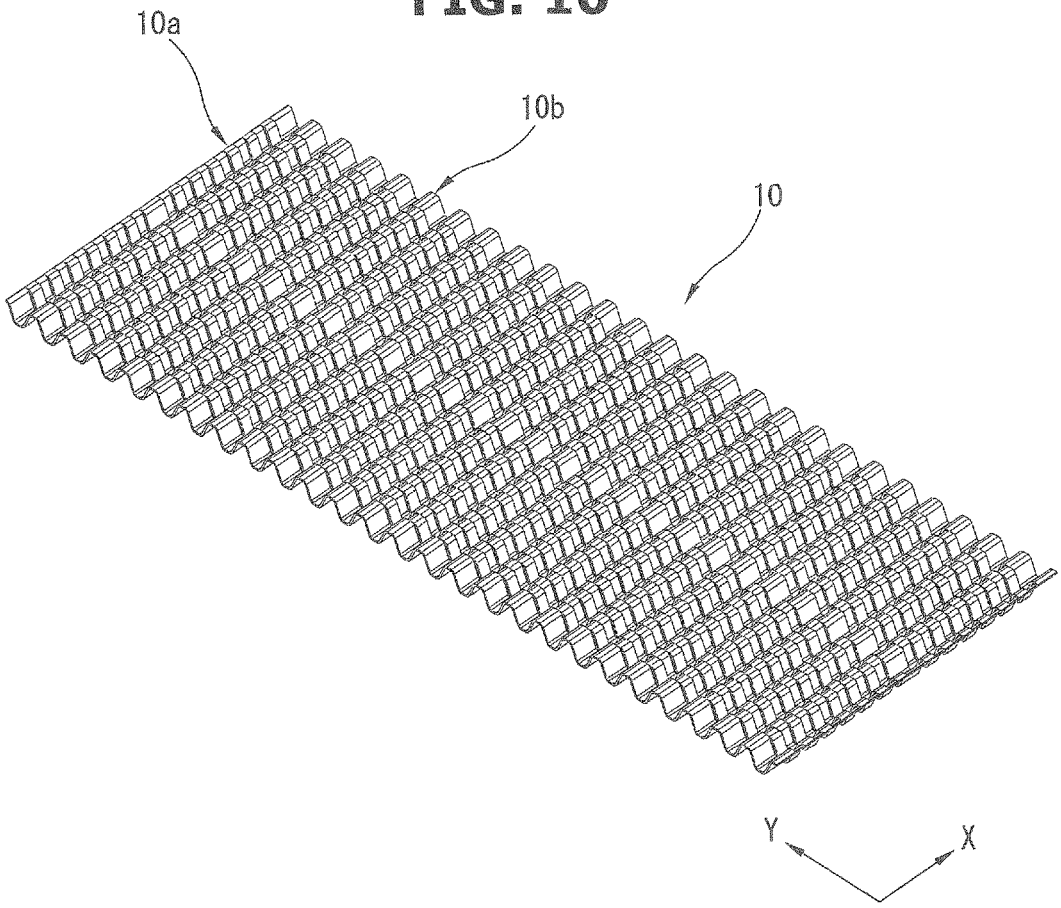
FIG. 10 is a perspective view showing the second fin plate used in the oil cooler according to the present invention.
Figure 11:
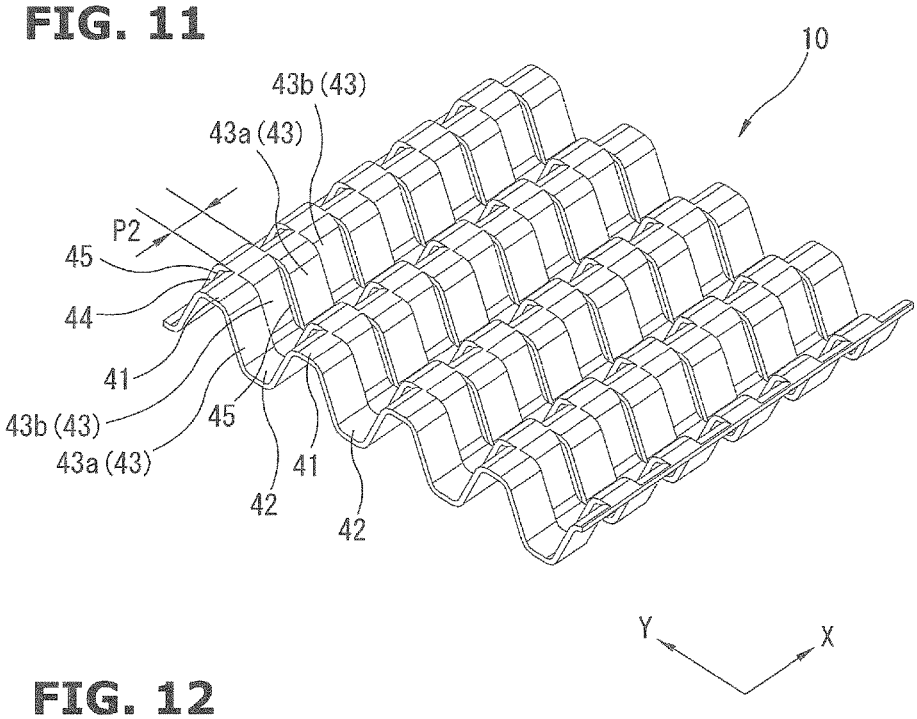
FIG. 11 is an enlarged explanation view showing a main part of the second fin plate used in the oil cooler according to the present invention.
Figure 12:
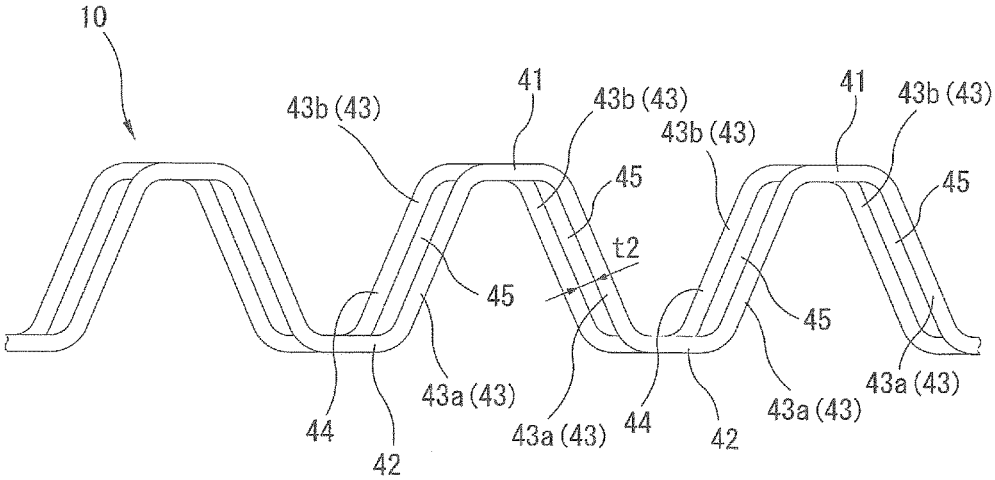
FIG. 12 is a sectional view showing a main part of the second fin plate used in the oil cooler according to the present invention.
Figure 13:
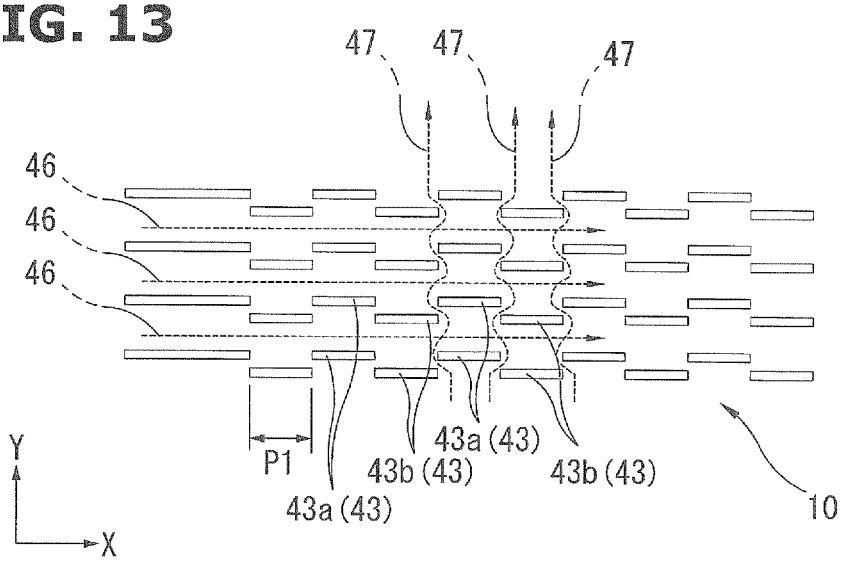
FIG. 13 is an enlarged sectional view which shows the second fin plate, and which is taken along a section line C-C of FIG. 3.

As shown in FIG. 10 to FIG. 12, the second fin plate 10 has a trapezoid (isosceles trapezoid) corrugate (waveform) shape in which the second fin plate 10 is repeatedly bended at a regular interval. That is, the second fin plate 10 is a corrugated fin formed by bending a base metal while sending the base metal in the Y direction.

As shown in FIG. 11 and FIG. 12, the second fin plate 10 includes top walls 41 which are positioned at top portions of the corrugated shape, and each of which is continuous in a zigzag in the X direction; bottom walls 42 which are positioned at bottom portions of the corrugated shape, and each of which is continuous in a zigzag in the X direction; and foot portions 43 each of which connects one of the top walls 41 and one of the bottom walls 42. Besides, the top walls 41 are substantially identical to the bottom walls 42.

Each of the foot portions 43 of the second fin plate 10 includes first walls 43*a*, and second walls 43*b* which is deviated by a predetermined pitch in the Y direction with respect to the first walls 43*a*. Two of the second walls 43*b* are positioned on both sides of each of the first walls 43*a* in the X direction. Two of the first walls 43*a* are positioned on both sides of each of the second walls 43*b* in the X direction. In this embodiment, each of the foot portions 43 is formed so as to repeat an order of the first wall 43*a*, the second wall 43*b*, the first wall 43*a*, and second wall 43*b* in the X direction.

Moreover, each of the foot portions 43 of one of the second fin plates 10 includes stepped walls 44 formed at a predetermined interval along one of the top walls 41 and one of the bottom walls 42. Each of the stepped walls 44 is a stepped wall between one of the first walls 43*a* and one of the second walls 43*b*. Accordingly, each of the foot portions 43 is formed into a rectangular corrugated shape along one of the top walls 41 and one of the bottom walls 42 by the first walls 43*a*, the second walls 43*b*, and the stepped walls 44 which are repeatedly formed in the X direction. Each of the stepped walls 44 is formed at a position apart from one of the top walls 41 and one of the bottom walls 42.

Furthermore, each of the foot portions 43 of the second fin plate 10 has the corrugated shape which has the same phase as the phase of one of the foot portions 43 that is adjacent to the each of the foot portions 43 in the Y direction. That is, in two of the foot portions 33 which are adjacent to each other in the Y direction, the first walls 43*a* confront the first walls 43*a*, and the second walls 43*b* confront the second walls 43*b*.

Each of the stepped walk 44 of one of the foot portions 43 of the second fin plate 10 includes an elongated opening portion 45 having a width equal to or smaller than a thickness of the second fin plate 10. That is, each of the stepped walls 44 of the foot portion 43 of the second fin plate 10 is a stepped surface in which the elongated opening portion 45 having the width equal to or smaller than a thickness of the second fin plate 10 can be formed.

Each of the opening portions 45 of the second fin plate 10 is an elongated through hole along the X direction. Each of the opening portions 45 of the second fin plate 10 may be, for example, an elongated opening having a width is t2 of about 0.15 mm in a case where the second fin plates 10 are used in the coolant circuit like this embodiment.

In a case where each of the above-described second fin plates 10 is formed, slits extending in the Y direction are intermittently formed in the base metal at a predetermined interval P2 in the X direction.

Then, the base metal in which the slits are formed is bent at predetermined positions in the opposite directions while being sent in the Y direction. With this, the second fin plate 10 is formed into the trapezoid corrugated shape. Moreover, the base metal is bent along the slits at the predetermined interval P2 in the X direction to be deviated by the predetermined pitch. With this, the foot portion 43 of the second fin plate 10 is formed into the corrugated shape in the X direction. That is, by bending the base metal along these slits, the stepped walls 44, and the opening portions 45 each having the width equal to or smaller than the thickness of the second fin plate 10 are formed in the second fin plate 10.

FIG. 13 is an enlarged sectional view which shows one of the foot portions 43 of the second fin plate 10, and which is taken along a section passing through the plate coolant flow passage 8 in parallel to the surfaces of the first core plate 5 and the second core plate 6.

The first walls 43*a*, and the second walls 43*c* of each of the second fin plates 10 are arranged (formed) in a line in a broken line shape by the opening portions 45 formed in the foot portion 43. Moreover, the rows of the adjacent walls are in a complement relationship. The entire are arranged in a staggered arrangement (in a zigzag shape).

Accordingly, when the coolant flows in the X direction, the coolant linearly flows between the rows of the adjacent foot portions 43 as shown by arrows 46, and the coolant flows through the opening portions 45. Consequently, a boundary layer is difficult to be generated. Moreover, the passage resistance is small. When the coolant flows in the Y direction, the coolant cannot linearly flow since the adjacent rows of the foot portions 43 are superimposed. The coolant flows meandering as shown by arrows 47. Moreover, the opening portions 45 through which the coolant passes when the coolant flows in the Y direction has the extremely small passage sectional area. Accordingly, the passage resistance becomes large when the coolant flows in the Y direction. That is, each of the second fin plates 10 has an anisotropy (anisotropism) in which the passage resistance in the X direction is different from the passage resistance in the Y direction. The passage resistance to the flow in the X direction (the direction along the above-described first reference line L1) is relatively small. The passage resistance to the flow in the Y direction (the direction along the above-described second reference line L2) is large.

Besides, in the above-described embodiment, the first fin plates 9 are disposed, respectively, in the plate oil flow passages 7. The second fin plates 10 are disposed, respectively, in the plate coolant flow passages 8. However, the second fin plates 10 may be disposed, respectively, in the plate oil flow passages 7. The first fin plates 9 may be disposed, respectively, in the plate coolant flow passages 8. Moreover, the first fin plates 9 may be disposed, respectively, in both the plate oil flow passages 7 and the plate coolant flow passages 8. Furthermore, the second fin plates 10 may be disposed, respectively, in both the plate oil flow passages 7 and the plate coolant flow passages 8.

In this embodiment, the direction of the anisotropy of the first fin plate 9 in the plate oil flow passage 7 is identical to the direction of the anisotropy of the second fin plate 10 in the plate coolant flow passage 8. Moreover, the oil introduction portion 18 and the coolant introduction portion 14 are disposed to sandwich the first and second fin plates 9 and 10 in the direction along the first reference line L1 of the first and second fin plates 9 and 10. Accordingly, the oil in each of the plate oil flow passages 7 flows in a direction opposite to the direction of the flow of the coolant of one of the plate coolant flow passages 8. That is, the direction of the substantially flow of the oil which is formed in each of the plate oil flow passages 7 is opposite to the direction of the substantially uniform flow of the coolant which is formed in one of the plate coolant flow passages 8. Specifically, the direction of the flow of the oil in each of the plate oil flow passages 7 is opposite to the direction of the flow of the coolant in the one of the plate coolant flow passages 8, in regions in which the first and second fin plates 9 and 10 are disposed. Moreover, the direction of the flow of the oil in each of the first fin plates 9 is opposite to the direction of the flow of the coolant in one of the second fin plates 10. Accordingly, in the regions in which the first and second fin plates 9 and 10 are disposed, the flow of the oil and the flow of the is coolant become opposed flows (counter flows). Consequently, it is possible to improve the heat exchanger efficiency.

In each of the plate oil flow passages 7, the first fin plate 9 is positioned between the pair of the oil through holes 11. Moreover, each of the plate oil flow passages 7 has the fluid resistance greater than the fluid resistance in one of the plate coolant flow passages 8. Accordingly, in the plate oil flow passage 7, even when the distance S1 between each of the oil through holes 11 and the first fin plate 9 is small as shown in FIG. 4, the oil introduced from one of the oil through holes 11 is easy to flow to the coolant through hole 12's side on the upstream side of the first fin plate 9 before the oil flows into the first fin plate 9. That is, in the plate oil flow passage 7, even when the distance S1 between the oil through hole 11 and the first fin plate 9 is small, it is possible to attain the substantially uniform flow of the oil which flows in the plate oil flow passage 7 along the first reference line L1, which is substantially uniform in the second reference line L2. Consequently, it is possible to effectively perform the heat exchange by using the entire of the first and second core plates 5 and 6.

In each of the plate coolant flow passages 8, the second fin plate 10 is positioned between the pair of the coolant through holes 12. Moreover, each of the plate coolant flow passages 8 has the fluid resistance smaller than the fluid resistance in one of the plate oil flow passages 7. Accordingly, in the plate coolant flow passage 8, it is necessary to widen the distance S2 between each of the coolant through holes 12 and the second fin plate 10, as shown in FIG. 9. That is, in a case where the clearance S2 is narrow, the coolant introduced from the coolant through hole 12 is difficult to flow the oil through hole 12's side on the upstream side of the second fin plate 10 since the fluid resistance is small in the plate coolant flow passage 8. Accordingly, the second fin plate 10 has a width which is in direction of the first reference line L1, and which is smaller than that of the first fin plate 9, so that the clearances S2 in the plate coolant flow passage 8 become large. With this, it is possible to attain the substantially uniform flow of the oil which flows in the plate coolant flow passage 8 along the first reference line L1, which is substantially uniform in the second reference line L2. Consequently, it is possible to effectively perform the heat exchange by using the entire of the first and second core plates 5 and 6.

The first fin plate 9 includes the opening portions 35 each of which is formed in one of the stepped walls 34, and each of which has the width equal to or smaller than the thickness of the first fin plate 9. With this, it is possible to relatively decrease the sizes of the stepped portions 34. Specifically, in the first fin plate 9, it is possible to decrease the protruding amounts of the first protruding walls 33*b* with respect to the reference walls 33*a*, and the protruding amounts of the second protruding walls 33*c* with respect to the reference walls 33*a*.

Accordingly, in the first fin plate 9, it is possible to decrease the bending intervals when the first fin plate 9 is repeatedly bent in the V-shape while being sent in the Y direction. With this, it is possible to increase the heat transfer area (heating area) per unit area of the first fin plate 9.

Moreover, the stepped walls 34 of the first fin plate 9 are formed at positions away from the top walls 31 and the bottom walls 32. Accordingly, in the first fin plate 9, the adjacent foot portions 33 and 33 are difficult to be contacted with each other near the bottom portion wall 32 and the top portion wall 31 in which a gap (distance) of the adjacent foot portions 33 and 33 becomes relatively narrow. Moreover, each of the foot portions 33 of the first fin plate 9 has the corrugated shape which has a phase identical to the phase of one of the foot portions 33 which is adjacent to the each of the foot portions 33 in the Y direction. Consequently, the adjacent foot portions 33 and 33 are hard to be contacted with each other. Therefore, in the first fin plate 9, it is possible to decrease the bending interval when the first fin plate 9 is repeatedly bent into the V-shape while being sent in the Y direction.

Furthermore, the foot portion 33 of the first fin plate 9 has the V-shaped corrugated shape. Accordingly, it is possible to decrease the bending interval while ensuring the interval between the top walls 31 and 31 (the bottom walls 32 and 32) which are adjacent to each other in the Y direction. Consequently, the first fin plate 9 can suppress the clogging of the foreign object. Besides, in a case where the first fin plate 9 is used in the oil circuit like this embodiment, the clearance (gap) between the top portions 31 and 31 (the bottom portion walls 32 and 32) which are adjacent to each other in the Y direction is ensured so that the foreign object having, for example, the diameter of substantially 0.5 mm is not caught in the clearance. Moreover, in a case where the first fin plate 9 is used in the coolant circuit, the clearance (gap) between the top portions 31 and 31 (the bottom portion walls 32 and 32) which are adjacent to each other in the Y direction is ensured so that the foreign object having, for example, the diameter of substantially 1 mm is not caught in the clearance.

The opening portions 35 are formed in each of the foot portions 33 of the first fin plate 9. Accordingly, the boundary layer is difficult to be developed on the surface of the each of the foot portions 33. Consequently, it is possible to suppress the decrease of the heat exchanger efficiency.

The second fin plate 10 includes the opening portions 45 each of which is formed in one of the stepped walls 44, and each of which has the width equal to or smaller than the thickness of the second fin plate 10. With this, it is possible to relatively decrease the sizes of the stepped portions 44. Specifically, in the second fin plate 10, it is possible to decrease the protruding amounts of the second walls 43*b* with respect to the first walls 43*a*.

Accordingly, in the second fin plate 10, it is possible to decrease the bending intervals when the second fin plate 10 is repeatedly bent in the trapezoid shape while being sent in the Y direction. With this, it is possible to increase the heat transfer area (heating area) per unit area of the second fin plate 10.

Moreover, the stepped walls 44 of the second fin plate 10 are formed at positions away from the top walls 41 and the bottom walls 42. Accordingly, in the second fin plate 10, the adjacent foot portions 43 and 43 are difficult to be contacted with each other near the bottom portion wall 42 and the top portion wall 41 in which a gap (distance) of the adjacent foot portions 43 and 43 becomes relatively narrow. Moreover, each of the foot portions 43 of the second fin plate 10 has the corrugated shape which has a phase identical to the phase of one of the foot portions 43 which is adjacent to the each of the foot portions 43 in the Y direction. Consequently, the adjacent foot portions 43 and 43 are hard to be contacted with each other. Therefore, in the second fin plate 10, it is possible to decrease the bending interval when the second fin plate 10 is repeatedly bent into the trapezoid shape while being sent in the Y direction.

Furthermore, the foot portion 43 of the second fin plate 10 has the trapezoid corrugated shape. Accordingly, it is possible to suppress the clogging of the foreign object by ensuring the interval between the top walls 41 and 41 (the bottom walls 42 and 42) which are adjacent to each other in the Y direction. Besides, in a case where the second fin plate 10 is used in the coolant circuit like this embodiment, the clearance (gap) between the top portions 41 and 41 (the bottom portion walls 42 and 42) which are adjacent to each other in the Y direction is ensured so that the foreign object having, for example, the diameter of substantially 1 mm is not caught in the clearance. Moreover, in a case where the second fin plate 9 is used in the coolant circuit, the clearance (gap) between the top portions 41 and 41 (the bottom portion walls 42 and 42) which are adjacent to each other in the direction is ensured so that the foreign object having, for example, the diameter of substantially 0.5 mm is not caught in the clearance.

The opening portions 45 are formed in each of the foot portions 43 of the second fin plate 10. Accordingly, the boundary layer is difficult to be developed on the surface of the each of the foot portions 43. Consequently, it is possible to suppress the decrease of the heat exchanger efficiency.

Next, a second embodiment is explained. Besides, the same symbols are added to the constituting elements which are identical to those of the first embodiment. The repetitive explanations are omitted.

Figure 14:
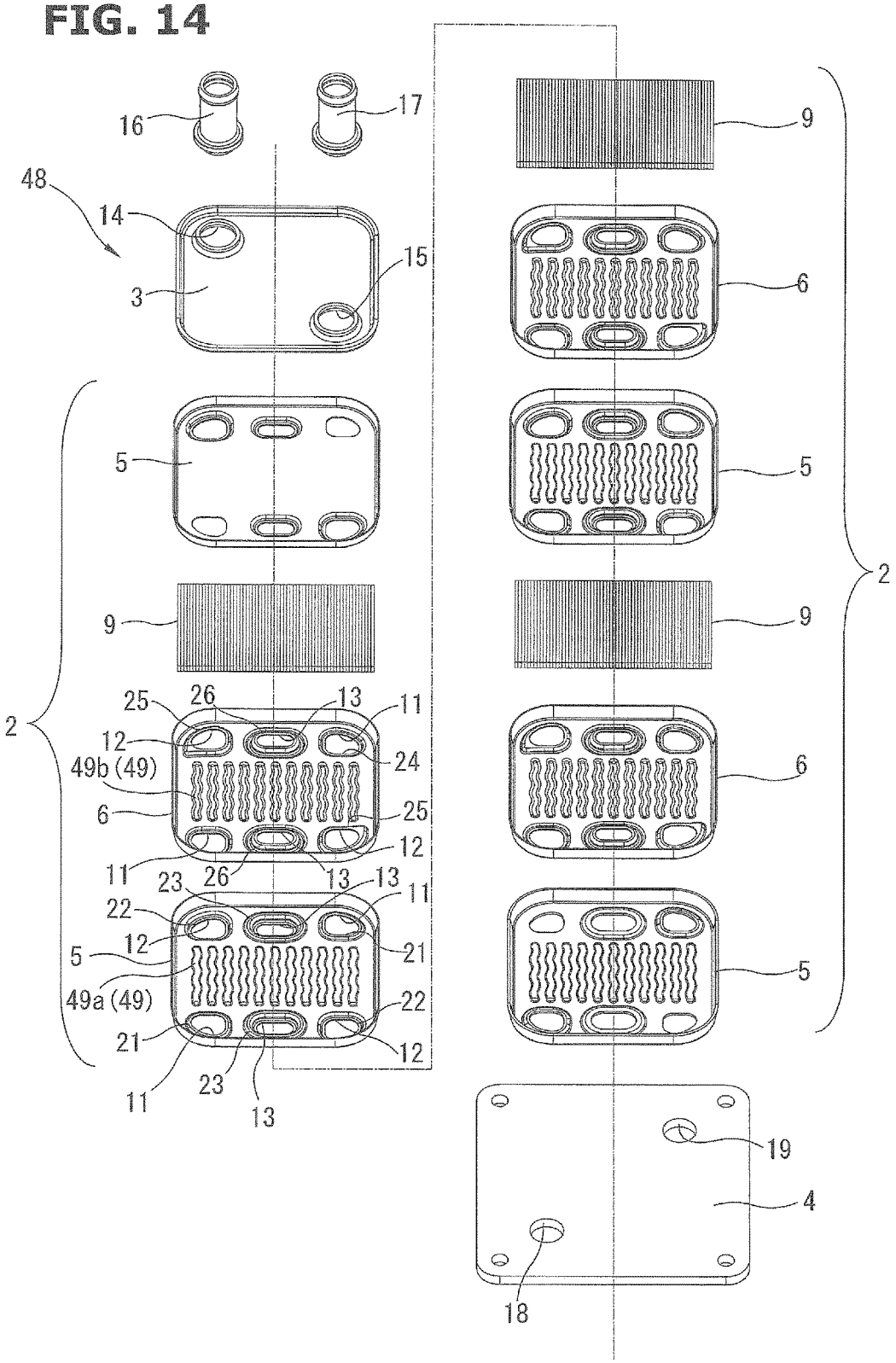
FIG. 14 is an exploded view showing an oil cooler according to a second embodiment of the present invention.
Figure 15:
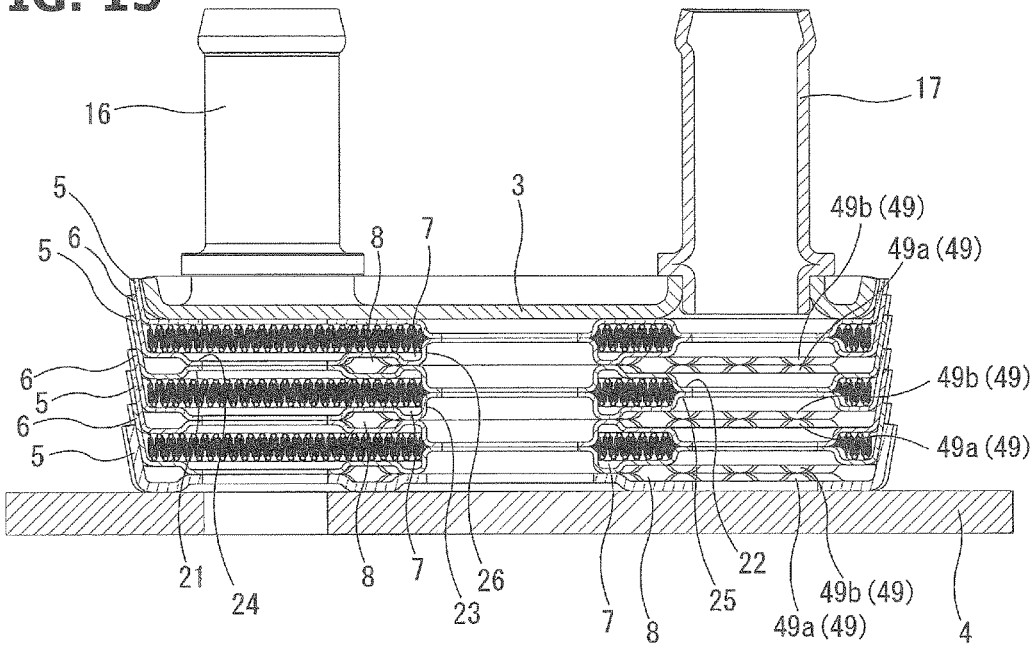
FIG. 15 is a sectional view showing a main part of the oil cooler according to the second embodiment of the present invention.
Figure 16:
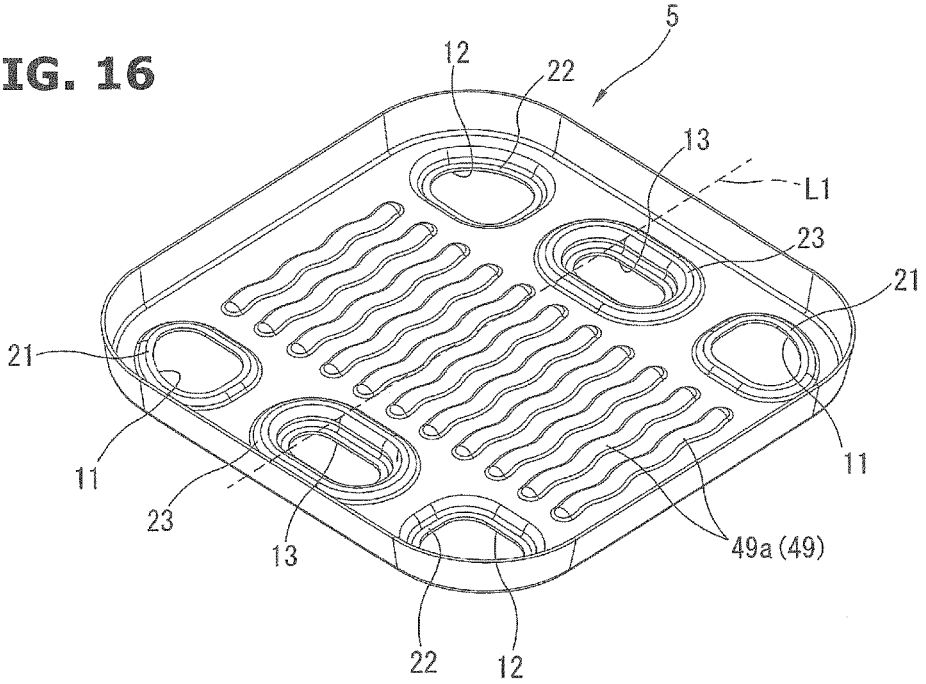
FIG. 16 is a perspective view showing a first core plate of the oil cooler according to the second embodiment of the present invention.
Figure 17:
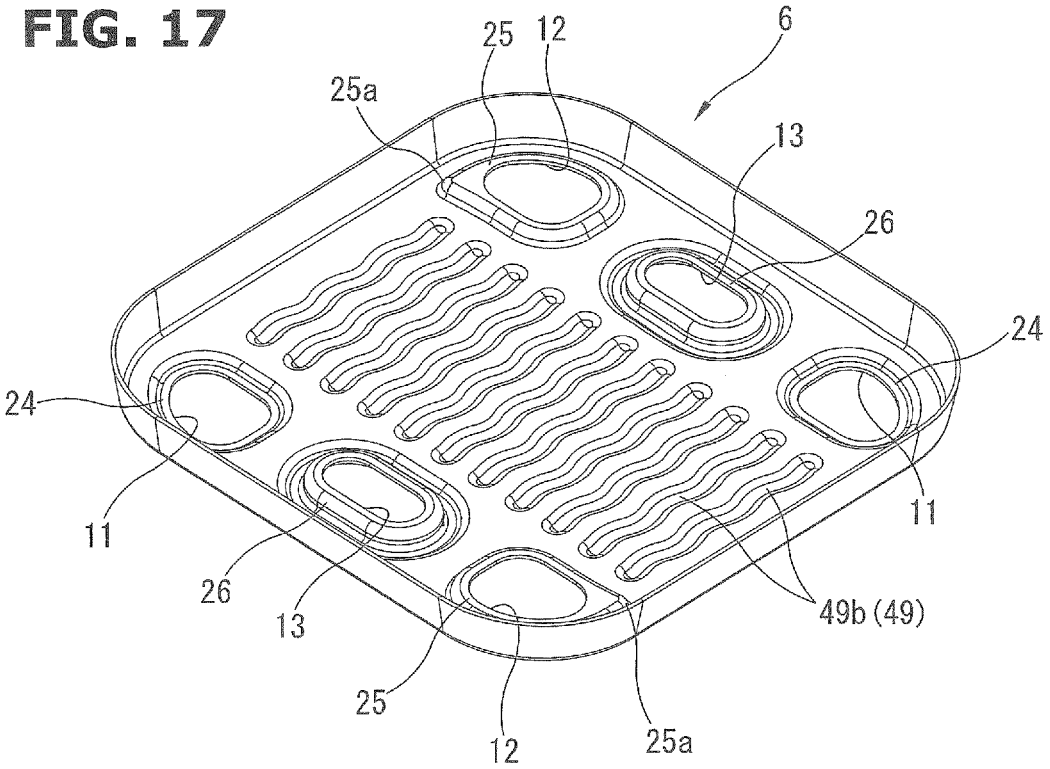
FIG. 17 is a perspective view showing a second core plate of the oil cooler according to the second embodiment of the present invention.

An oil cooler 48 which is a heat exchanger according to a second embodiment of the present invention is explained with reference to FIG. 14 to FIG. 17. FIG. 14 is an exploded perspective view showing the oil cooler according to the second embodiment. FIG. 15 is a sectional view which shows main parts of the oil cooler 48, and which is taken along a section line A-A of FIG. 2. FIG. 16 is a perspective view showing the first core plate according to the second embodiment. FIG. 17 is a perspective view showing the second core plate 6 in the second embodiment.

In the second embodiment, the oil cooler 48 has a structure substantially identical to that of the above-described first embodiment. However, the plate coolant flow passage 8 is provided with the plurality of protrusions 49, in place of the second fin plates 10.

The protrusions 49 extends in a direction parallel to the first reference line L1 of the first fin plate 9. The protrusions 49 includes first protruding portions 49*a* of the first core plate 5, and second protruding portions 49*b* of the second core plate 6.

Specifically, as shown in FIG. 14 to FIG. 16, the first core plate 5 includes the first protrusions 49*a* protruding toward the plate coolant flow passage 8. Each of the first protrusions 49*a* is a recessed groove which has a substantially U-shaped section when viewed from the plate oil flow passage 7, and which is formed in the first core plate 5.

As shown in FIG. 14, FIG. 15, and FIG. 17, the second core plate 6 includes the first protrusions 49*b* protruding toward the plate coolant flow passage 8. Each of the second protrusions 49*b* is a recessed groove which has a substantially U-shaped section when viewed from the plate oil flow passage 7, and which is formed in the second core plate 6.

In this second embodiment, tip ends of the first protruding portions 49*a* and the second protruding portions 49*b* are connected by brazing. A plurality of elongated water passages are formed between the protrusions 49 in the plate coolant flow passage 8. Each of the elongated water passages are independently provided. Each of the elongated water passages extends in a direction parallel to the first reference line L1 of the first fin plate 9.

When the oil cooler 48 is viewed in a planner view, the protrusions 48 are provided in a region in which the protrusions 49 is superimposed with the first fin plate 9 of the plate coolant flow passage 8. That is, the protrusions 49 are formed in a region in which the protrusions 49 are superimposed with the region in which the first fin plate 9 is disposed.

In this oil cooler 48 according to the second embodiment, it is possible to form the flow substantially parallel to the first reference line L1 within the plate oil flow passage and the plate coolant flow passage, by the first fin plate 9 and the protrusions 49. Accordingly, it is possible to form the uniform flow parallel to the first reference line L1 by the first fin plate 9 and the protrusions 49, and thereby to effectively perform the heat exchange by using the entire of the first and second core plates 5 and 6. That is, in the oil cooler 48 according to the second embodiment, it is possible to attain the effects and the operations which are substantially identical to those of the first embodiment.

Moreover, in this second embodiment, it is possible to omit the fin plates of the plate coolant flow passages 8, and thereby to decrease the number of the components relative to the first embodiment.

Besides, the protrusions 49 of the plate coolant flow passage 8 may be constituted only by the first protruding portions 49*a*. In this case, tip ends of the first protruding portions 49*a* are connected by the brazing on the flat back surface of the second core plate 6. Moreover, the protrusions 49 of the plate coolant flow passage 8 may be constituted only by the second protruding portions 49*b*. In this case, tip ends of the second protruding portions 49*b* are connected by the brazing on the back bottom surface of the flat second core plate 6. In this way, it is possible to attain the effect and the operations which are substantially identical to those of the first embodiment.

Moreover, the protrusions 49 may be provided to the plate oil flow passages 7, in place of the plate coolant flow passages 8. That is, the protrusions 49 may be provided to the plate oil flow passage 7, in place of the first fin plate 9. The second fin plate 10 may be disposed in the plate coolant flow passage 8. In this structure, it is possible to attain the same effects and the same operations which are substantially identical to those of the first embodiment.

In the second embodiment, the protrusions 49 has the corrugated shape in a direction parallel to the first reference line L1 of the first fin plate 9. However, the protrusions 49 may have a linear shape in a direction parallel to the first reference line L1 of the first fin plate 9.

The fin plate used in the oil coolers 1 and 48 described above is not limited to the first and second fin plates 9 and 10. When a first reference line and a second reference line are defined as lines which pass through a center of the fin plate in a plane of the fin plate, and which are perpendicular to each other in the plate of the fin plate, it is optional to employ the structures of the first and second fin plates 9 and 10 as long as the first and second fin plates 9 and 10 has an anisotropy in which the flow resistance in the direction parallel to the first reference line is smaller than the flow resistance in the direction parallel to the second reference line.

For example, a below-described third fin plate 50 may be used in place of the first fin plate 9 and the second fin plate 10.

FIG. 18 to FIG. 22 shows a third fin plate 50 which are another embodiment of the first fin plate 9 and the second fin plate 10.

Each of the third fin plates 50 which is the fin plate has a substantially rectangular outer profile including a pair of longitudinal sides 50*a* confronting each other; and a pair of lateral sides 50*b* confronting each other.

Figure 18:
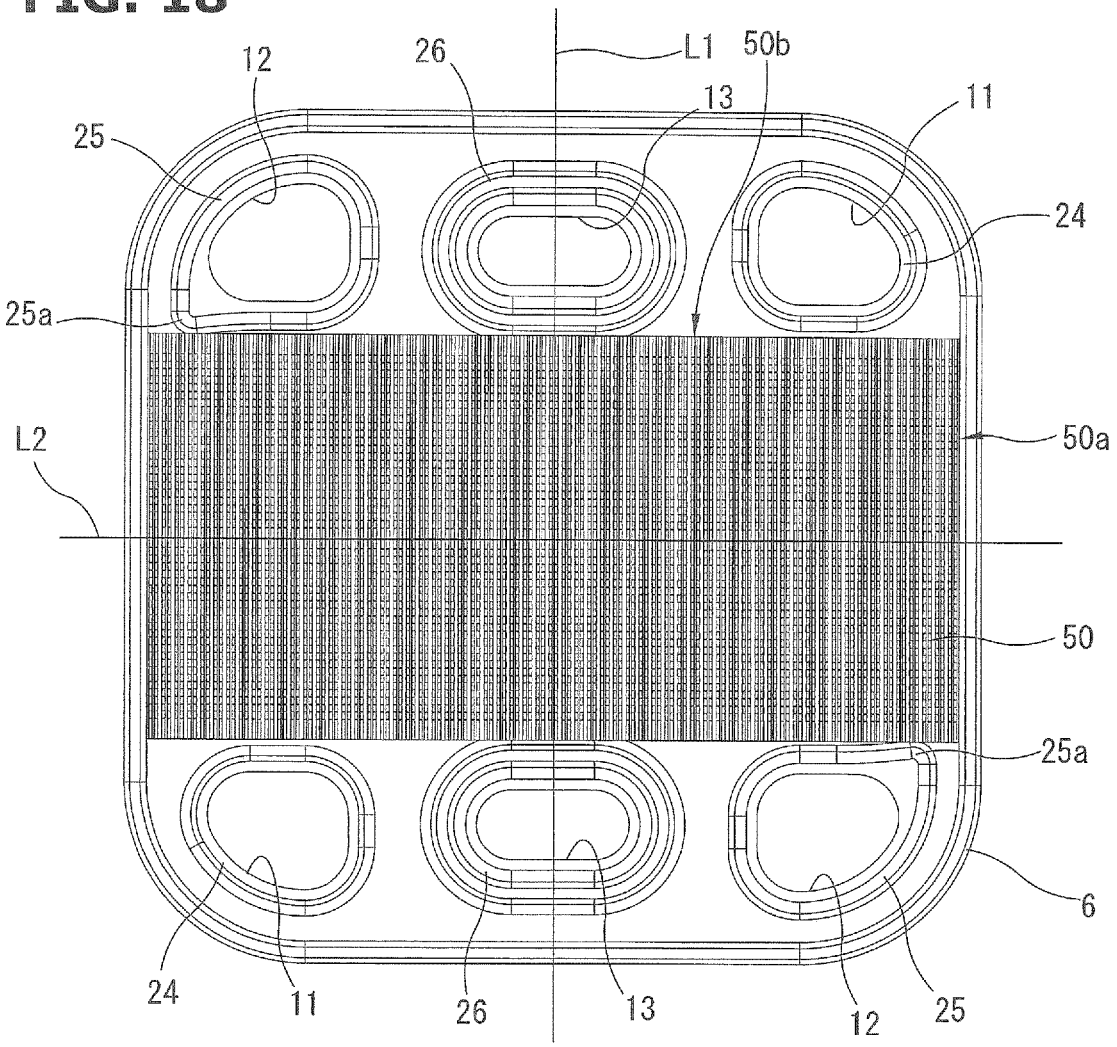
FIG. 18 is an explanation view showing a relationship between the third fin plate and the second core plate which are applicable to the oil cooler according to the present invention.

As shown in FIG. 18, each of the third fin plates 50 is positioned by the boss portions 25 of one of the second core plates 6 in a case where the each of the third fin plates 50 is disposed in the plate oil flow passage 7. Specifically, in this example, each of the third fin plates 50 is positioned between a pair of the boss portions 25 and 25 which confronts each other, by positioning protrusions 25*a* each protruding from one of the boss portions 25 and 25 toward the other of the boss portions 25 and 25.

In a case where a first reference line L1 and a second reference line L2 are defined as lines which pass through a center of the fin plate in a plane of one of the third fin plates 50, and which are perpendicular to each other in the plane of the one of the third fin plates 50, each of the third fin plates 50 has an anisotropy (anisotropic) in which a flow resistance in a direction parallel to the first reference line L1 is smaller than a flow resistance in a direction parallel to the second reference line L2. That is, each of the third fin plates 50 has an anisotropy in which a flow resistance in a direction parallel to the lateral side 50*b* is greater than a flow resistance in a direction parallel to the longitudinal side 50*a*.

Each of the third fin plates 50 is formed so that the both ends (upper and lower ends in FIG. 18) of the each of the third fin plates 50 are positioned on the center side of one of the second core plates 6 relative to the oil through holes 11 and the coolant through holes 12 in a direction along the first reference line L1. Moreover, each of the third fin plates 50 is formed so that the both ends (left and right ends in FIG. 18) of the each of the third fin plates 50 extend between one of the oil through holes 11 and one of the coolant through holes 12 in a direction along the second reference line L2. That is, each of the third fin plates 50 has a length of the lateral side 50*b* (which is parallel to the second reference line L2) which is substantially identical to a width of the plate oil flow passage 7. Furthermore, in the plate oil flow passage 7, each of the oil through holes 11 and the coolant through holes 12 is positioned between one of the lateral sides 50*b* of the third fin plate 50, and an outer circumference edge of the second core plate 6 which corresponds to the one of the lateral sides 50*b*, without being covered with the third fin plate 50.

That is, each of the second core plates 6 includes rectangular regions each of which is adjacent to one of the lateral sides 50*b* of the third fin plate 50, and each of which is not covered with the third fin plate 50. Each of the oil through holes 11 and each of the coolant through holes 12 are positioned at one of these rectangular regions. That is, the two oil through holes 11 are positioned to sandwich the third fin plate 50 in a direction along the first reference line L1. The two coolant through holes 12 are positioned to sandwich the third fin plate 50 in a direction along the first reference line L1. Accordingly, in this example, in the plate oil flow passage 7, it is possible to produce a substantially uniform flow of the oil which flows in a in a direction parallel to the first reference line L1 of the third fin plate 50, and which is uniform in the second reference line L2, by the third fin plate 50.

The third fin plate 50 is explained in detail with reference to FIG. 19 to FIG. 22. Besides, for the explanation, two directions which are perpendicular to each other in the plane of the third fin plate 50 are defined as an X direction and a Y direction, as shown in FIG. 19, FIG. 20, and FIG. 22.

Figure 19:
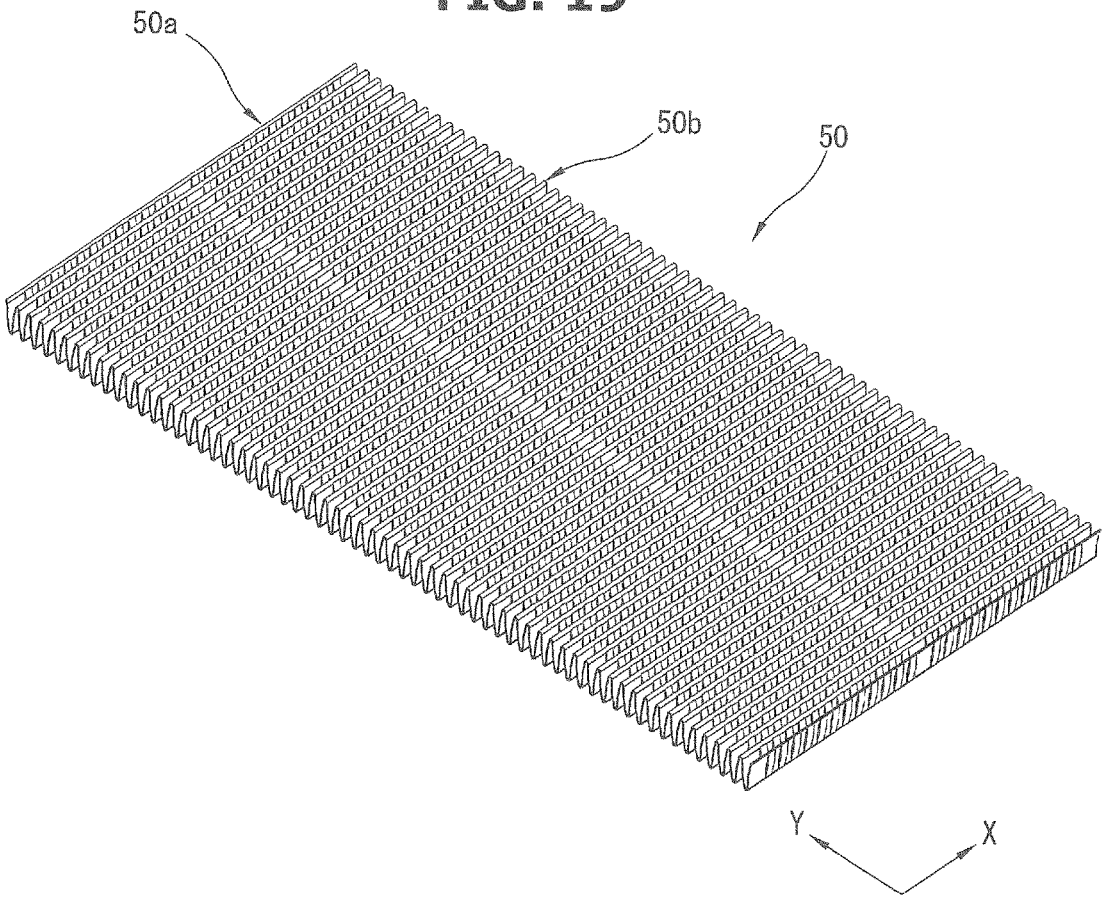
FIG. 19 is a perspective view showing the third fin plate which is applicable to the oil cooler according to the present invention.
Figure 20:
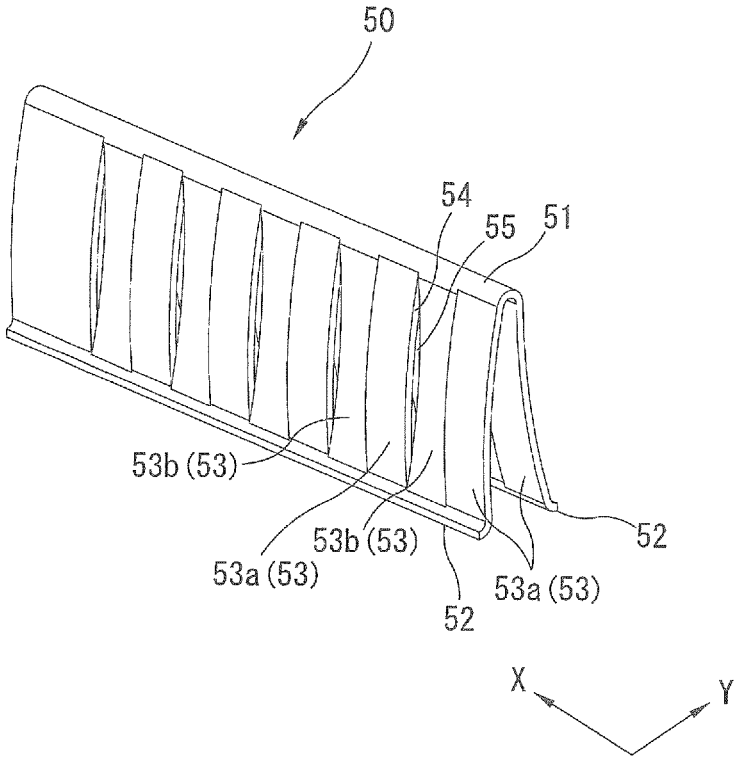
FIG. 20 is an enlarged explanation view showing a main portion of the third fin plate which is applicable to the oil cooler according to the present invention.
Figure 21:
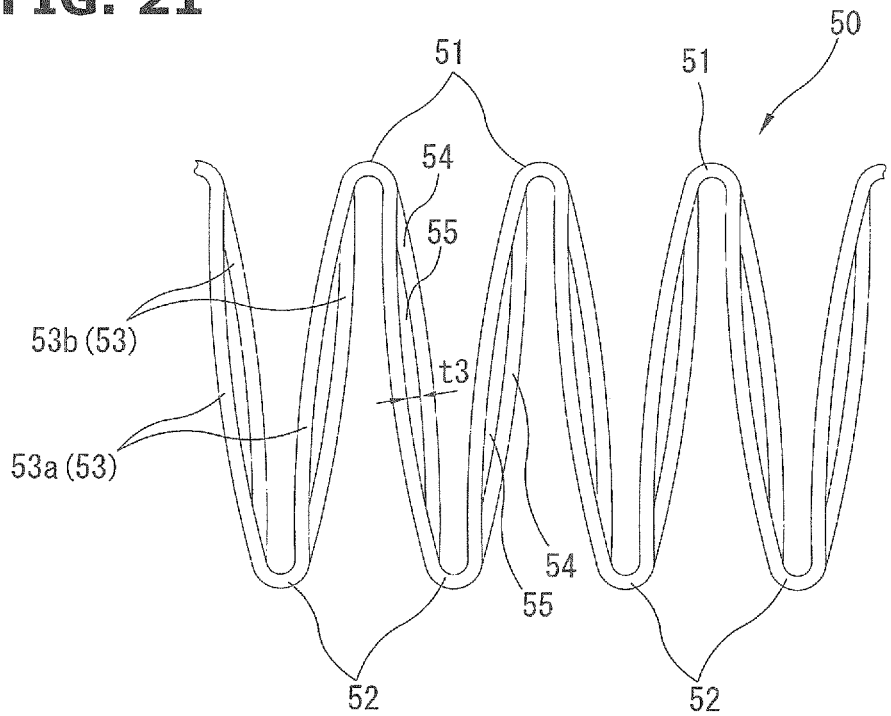
FIG. 21 is a sectional view showing the main portion of the third fin plate which is applicable to the oil cooler according to the present invention.
Figure 22:
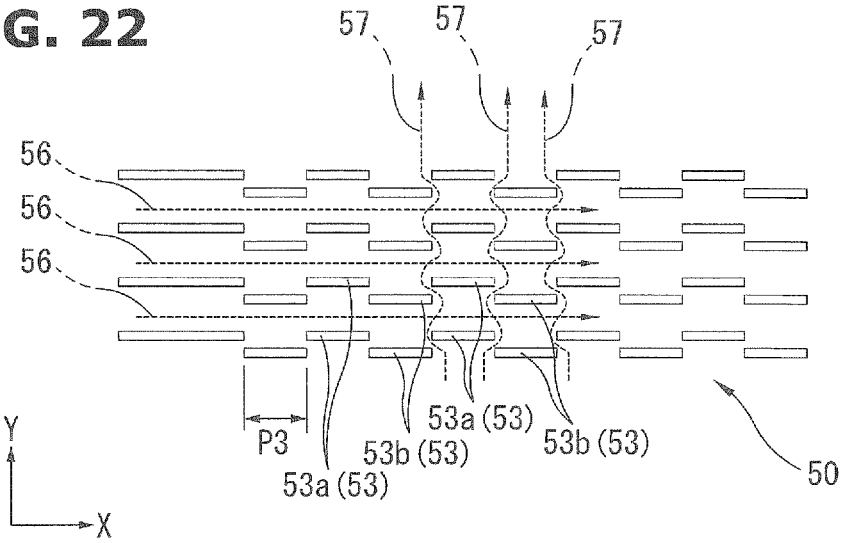
FIG. 22 is an enlarged sectional view which shows the third fin plate, and which is taken along a section line corresponding to the section line B-B of FIG. 3.

As shown in FIG. 19 to FIG. 21, the third fin plate 50 has a V-shaped corrugated (waveform) shape in which the first fin plate 9 is repeatedly bended at a regular interval. That is, the third fin plate 50 is a corrugated fin formed by bending a base metal while sending the base metal in the Y direction.

As shown in FIG. 20 and FIG. 21, the third fin plate 50 includes top walls 51 which are positioned at top portions of the corrugated shape, and each of which is continuous in the X direction; bottom walls 52 which are positioned at bottom portions of the corrugated shape, and each of which is continuous in the X direction; and foot portions 53 each of which connects one of the top walls 51 and one of the bottom walls 52. Besides, the top walls 51 are substantially identical to the bottom walls 52.

Each of the foot portions 53 of the third fin plate 50 includes first walls 53*a* each of which is raised toward one of the foot portions 53 which are adjacent to the each of the foot portions 53 in the Y direction; and second walls 53*b* each of which is raised toward the other of the foot portions 53 which are adjacent to the each of the foot portions 53 in the Y direction.

The first walls 53*a* and the second walls 53*b* are repeatedly alternatingly formed in each of the foot portions 53 of the third fin plate 50 in the X direction.

Moreover, each of the foot portions 53 of one of the third fin plates 50 includes stepped walls 54 formed at a predetermined interval along one of the top walls 51 and one of the bottom walls 52. Each of the stepped walls 54 is a stepped surface between one of the first walls 53*a* and one of the second walls 53*b*. Accordingly, each of the foot portions 53 is formed into a rectangular corrugated shape along one of the top walls 53*a* and one of the bottom walls 53*b* by the first walls 53*a*, the second walls 53*b*, and the stepped walls 54 which are repeatedly formed in the X direction. Each of the stepped walls 54 is formed at a position apart from one of the top walls 51 and one of the bottom walls 52.

Furthermore, each of the foot portions 53 of the third fin plate 50 has the corrugated shape which has the same phase as the phase of the one of the foot portions 53 that is adjacent to the each of the foot portions 53 in the Y direction. That is, in two of the foot portions 53 which are adjacent to each other in the Y direction, the first walls 53*a* confronts the first walls 53*a*, and the second walls 53*b* confronts the second walls 54*a*.

Each of the stepped walls 54 of one of the foot portions 53 of the third fin plate 50 includes an elongated opening portion 55 having a width equal to or smaller than a thickness of the third fin plate 50. That is, each of the stepped walls 54 of the foot portion 53 of the third fin plate 50 is a stepped surface in which the elongated opening portion 55 having the width equal to or smaller than a thickness of the third fin plate 50 can be formed.

Each of the opening portions 55 of the third fin 50 is an elongated through hole along the X direction. Each of the opening portions 55 of the third fin plate 50 may be, for example, an elongated opening having a width t3 of about 0.1 mm in a case where the third fin plates 50 are used in the oil circuit.

In a case where each of the above-described third fin plates 50 is formed, slits extending in the Y direction are intermittently formed in the base metal at a predetermined interval P3 in the X direction. Then, by bending the base metal along these slits, each of the foot portions 53 of the third fin plate 50 becomes the corrugated shape in the X direction. That is, by bending the base metal along these slits, the stepped walls 54, and the elongated opening portions 55 each having the width equal to or smaller than the thickness of the third fin plate 50 are formed in the third fin plate 50.

Then, the base metal in which the opening portions 55 each having the extremely small passage sectional area are formed is bent at predetermined positions in the opposite directions while being sent in the Y direction. With this, the third fin plate 50 is formed into the V-shaped corrugated shape.

FIG. 22 is an enlarged sectional view which shows one of the foot portions 53 of the third fin plate 50, and which is taken along a section passing through the plate oil flow passage 7 in parallel to the surfaces of the first core plate 5 and the second core plate 6.

The first walls 53*a* and the second walls 53*b* of each of the third fin plates 50 are arranged (formed) in a line in a broken line shape by the opening portions 55 formed in the foot portion 53. Moreover, the rows of the adjacent walls are in a complement relationship. The entire are arranged in a staggered arrangement (in a zigzag shape).

Accordingly, when the oil flows in the X direction, the oil linearly flows between the rows of the adjacent foot portions 53 as shown by arrows 56, and the oil flows through the opening portions 55. Consequently, a boundary layer is difficult to be generated. Moreover, the passage resistance is small. When the oil flows in the Y direction, the oil cannot linearly flow since the adjacent rows of the foot portions 53 are superimposed. The oil flows meandering as shown by arrows 57. Moreover, the opening portions 55 through which the oil passes when the oil flows in the Y direction has the extremely small passage sectional area. Accordingly, the passage resistance becomes large when the oil flows in the Y direction. That is, each of the third fin plates 50 has an anisotropy (anisotropism) in which the passage resistance in the X direction is different from the passage resistance in the Y direction. The passage resistance to the flow in the X direction (the direction along the above-described first reference line L1) is relatively small. The passage resistance to the flow in the Y direction (the direction along the above-described second reference line L2) is extremely large.

In each of the fin plates 3, it is possible to attain the effects and the operations which are identical to those of the first fin plates 9 and the second fin plates 10 described above.

That is, the third fin plate 50 includes the opening portions 55 each of which is formed in one of the stepped walls 54, and each of which the width equal to or smaller than the thickness of the third fin plate 50. With this, it is possible to relatively decrease the sizes of the stepped portions 54. Specifically, in the third fin plate 50, it is possible to decrease the protruding amounts of the second walls 53*b* with respect to the first walls 53*a*.

Accordingly, in the third fin plate 50, it is possible to decrease the bending intervals when the third fin plate 50 is repeatedly bent in the V-shape while being sent in the Y direction. With this, it is possible to increase the heat transfer area (heating area) per unit area of the third fin plate 50.

Moreover, the stepped walls 54 of the third fin plate 50 are formed at positions away from the top walls 51 and the bottom walls 52. Accordingly, in the third fin plate 50, the adjacent foot portions 53 and 53 are difficult to be contacted with each other near the bottom portion wall 52 and the top portion wall 51 in which a gap (distance) of the adjacent foot portions 53 and 53 becomes relatively narrow. Moreover, each of the foot portions 53 of the third fin plate 50 has the corrugated shape which has a phase identical to the phase of one of the foot portions 53 which is adjacent to the each of the foot portions 53 in the Y direction. Consequently, the adjacent foot portions 53 and 53 are hard to be contacted with each other. Therefore, in the third fin plate 50, it is possible to decrease the bending interval when the third fin plate 50 is repeatedly bent into the V-shape while being sent in the Y direction.

Furthermore, the foot portion 53 of the third fin plate 50 has the V-shaped corrugated shape. Accordingly, it is possible to decrease the bending interval while ensuring the interval between the top walls 51 and 51 (the bottom walls 52 and 52) which are adjacent to each other in the Y direction. Consequently, the third fin plate 50 can suppress the clogging of the foreign object. Besides, in a case where the third fin plate 50 is used in the oil circuit, the clearance (gap) between the top portions 51 and 51 (the bottom portion walls 52 and 52) which are adjacent to each other in the Y direction is ensured so that the foreign object having, for example, the diameter of substantially 0.5 mm is not caught in the clearance. Moreover, in a case where the third fin plate 50 is used in the coolant circuit, the clearance (gap) between the top portions 51 and 51 (the bottom portion walls 52 and 52) of the foot portion 53 which are adjacent to each other in the Y direction is ensured so that the foreign object having, for example, the diameter of substantially 1 mm is not caught in the clearance.

The opening portions 55 are formed in each of the foot portions 53 of the third fin plate 50. Accordingly, the boundary layer is difficult to be developed on the surface of the each of the foot portions 53. Consequently, it is possible to suppress the decrease of the heat exchanger efficiency.

Specifically, the pair of the oil holes are positioned on a diagonal line of one of the core plates; and the pair of the coolant holes are positioned on a diagonal line of the one of the core plates which is not different from the diagonal line on which the pair of the oil holes are formed.

The fin plates may be disposed, respectively, in the plate oil flow passages and the plate coolant flow passages.

Each of the fin plates may be disposed in one flow passage of the plate oil flow passages and the plate coolant flow passages; and each of the core plates may include a plurality of protrusions each of which extends in a direction parallel to the first reference line within one of the plate flow passages in which one of the fin plates is not disposed.

A direction of a flow of the oil within the plate oil flow passage may be different from a direction of a flow of the coolant within the plate coolant flow passage.

In the present invention, it is possible to form the flow which is parallel to the first reference line in the flow passage between the core plates in which the fin plate is disposed, and which is substantially uniform flow. It is possible to effectively perform the heat exchange by using the entire core plates.

The entire contents of Japanese Patent Application No. 2016-194040 filed Sep. 30, 2016 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A heat exchanger comprising:

a plurality of rectangular core plates that are stacked;

a plurality of plate oil flow passages and a plurality of plate coolant flow passages alternatingly formed between the plurality of the core plates;

a plurality of rectangular fin plates each disposed at one or more flow passages of the plurality of the plate oil flow passages or the plate coolant flow passages;

the core plates each including a pair of oil holes and a pair of coolant holes;

in a case where a first reference line and a second reference line are defined as lines which pass through a center of one of the fin plates, and which are perpendicular to each other in a plane of each of the core plates, each of the fin plates have anisotropy such that a passage resistance in a direction parallel to the first reference line is smaller than a passage resistance parallel to the second reference line, the pair of the oil holes being positioned on an outer edge of one of the core plates, the pair of the oil holes being positioned at symmetrical positions with respect to a center of the one of the core plates to sandwich the center of the one of the core plates, and the pair of the oil holes being positioned to sandwich one of the fin plates along the first reference line, and the pair of the coolant holes being positioned on the outer edge of the one of the core plates, the pair of the coolant holes being positioned at symmetrical positions with respect to the center of the one of the core plates to sandwich the center of the one of the core plates, and the pair of the coolant holes being positioned to sandwich the one of the fin plates along the first reference line, wherein the pair of the oil holes are positioned on a diagonal line of one of the core plates, and the pair of the coolant holes are positioned on a diagonal line of the one of the core plates which is different from the diagonal line on which the pair of the oil holes are formed, and wherein at least one flow passage of the plurality of plate oil flow passages or the plurality of plate coolant flow passages is formed having a length and a width, such that the one of the fin plates extends along an entirety of the width of the at least one flow passage but only along a portion of the length of the at least one flow passage, so as to occupy only part of the at least one flow passage between the pair of oil holes or the pair of coolant holes.

2. The heat exchanger as claimed in claim 1, wherein the fin plates are disposed, respectively, in the plate oil flow passages and the plate coolant flow passages.

3. The heat exchanger as claimed in claim 1, wherein:

each of the fin plates is disposed in a respective one of the flow passages of the plate oil flow passages and the plate coolant flow passages; and each of the core plates includes a plurality of protrusions each of which extends in a direction parallel to the first reference line within one of the plate flow passages in which one of the fin plates is not disposed.

4. The heat exchanger as claimed in claim 1, wherein a direction of a flow of the oil within at least one of the plate oil flow passages is different from a direction of a flow of the coolant within at least one of the plate coolant flow passages.

5. A heat exchanger comprising:

a plurality of rectangular core plates that are stacked;

a plurality of plate oil flow passages and a plurality of plate coolant flow passages alternatingly formed between the plurality of the core plates; and a plurality of rectangular fin plates, one or more of the plurality of fin plates being disposed respectively at one or more flow passages of the plurality of the plate oil flow passages or the plate coolant flow passages;

a plurality of the core plates including a pair of oil holes and a pair of coolant holes;

in a case where a first reference line and a second reference line are defined as lines which pass through a center of one of the fin plates, and which are perpendicular to each other in a plane of one or more of the core plates, one or more of the fin plates have anisotropy such that a passage resistance in a direction parallel to the first reference line is smaller than a passage resistance parallel to the second reference line, the pair of the oil holes being positioned on an outer edge of one of the core plates, the pair of the oil holes being positioned at symmetrical positions with respect to a center of the one of the core plates to sandwich the center of the one of the core plates, and the pair of the oil holes being positioned to sandwich one of the fin plates along the first reference line, and the pair of the coolant holes being positioned on the outer edge of the one of the core plates, the pair of the coolant holes being positioned at symmetrical positions with respect to the center of the one of the core plates to sandwich the center of the one of the core plates, and the pair of the coolant holes being positioned to sandwich the one of the fin plates along the first reference line, wherein the pair of the oil holes are positioned on a diagonal line of one of the core plates, and the pair of the coolant holes are positioned on a diagonal line of the one of the core plates which is different from the diagonal line on which the pair of the oil holes are formed, and wherein the pair of oil holes and the pair of coolant holes are separated from the one of the fin plates by a clearance such that the one of the fin plates is spaced from the outer edge of the one of the core plates, and the pair of oil holes and the pair of coolant holes being free of the one of the fin plates.

* * * * *